US008065851B2

(12) United States Patent
Scoville et al.

(10) Patent No.: US 8,065,851 B2
(45) Date of Patent: Nov. 29, 2011

(54) SELF-SPACING WOOD COMPOSITE PANELS

(75) Inventors: Christopher R. Scoville, Carnesville, GA (US); Joel F. Barker, Townville, SC (US); David R. Willis, Bishop, GA (US); Feipeng Liu, Dacula, GA (US); Jeffrey W. Hanna, Athens, GA (US); Nian-hua Ou, Dacula, GA (US)

(73) Assignee: Huber Engineered Woods LLC, Charlotte, NC (US)

( * ) Notice: Subject to any disclaimer, the term of this patent is extended or adjusted under 35 U.S.C. 154(b) by 909 days.

(21) Appl. No.: 11/467,450

(22) Filed: Aug. 25, 2006

(65) Prior Publication Data

US 2008/0047212 A1 Feb. 28, 2008

(51) Int. Cl.
*E04B 2/00* (2006.01)

(52) U.S. Cl. ..... 52/506.1; 52/592.4

(58) Field of Classification Search ..... 52/603, 52/392, 592.4, 591.4, 506.1, 384
See application file for complete search history.

(56) References Cited

U.S. PATENT DOCUMENTS

| | | | | |
|---|---|---|---|---|
| 168,672 | A | 10/1875 | Reed | |
| 213,740 | A | 4/1879 | Conner | |
| 311,593 | A | 2/1885 | Mark | |
| 422,584 | A | 3/1890 | Finley | |
| 903,300 | A * | 11/1908 | Marvick | 52/392 |
| 1,058,674 | A | 4/1913 | Kertes | |
| 1,694,665 | A | 9/1927 | Parker | |
| 1,756,583 | A | 10/1928 | Cadwallader | |
| 1,808,591 | A | 4/1929 | Bruce | |
| 1,971,010 | A | 1/1932 | Korn | |
| 2,008,244 | A | 7/1935 | Crooks | |
| 2,020,815 | A | 7/1935 | Brandenberger | |
| 2,027,292 | A | 1/1936 | Rockwell | |
| 2,116,900 | A | 5/1938 | Klicka | |
| 2,872,882 | A | 2/1959 | Paul | |
| 2,902,733 | A | 9/1959 | Justus | |
| 3,077,703 | A | 2/1963 | Bergstrom | |
| 3,267,823 | A | 8/1966 | Macrae | |
| 3,314,206 | A | 4/1967 | Dau | |
| 3,345,048 | A | 10/1967 | Phelps | |
| 3,422,588 | A | 1/1969 | Stewart, Jr. | |
| 3,626,904 | A | 12/1971 | Hatten | |
| 3,943,678 | A | 3/1976 | Ehrenberg et al. | |
| 4,063,395 | A | 12/1977 | Stewart et al. | |

(Continued)

FOREIGN PATENT DOCUMENTS

| | | |
|---|---|---|
| CA | 914370 | 11/1972 |

(Continued)

*Primary Examiner* — Basil Katcheves
(74) *Attorney, Agent, or Firm* — Gardner Groff Greenwald & Villanueva, PC

(57) ABSTRACT

A composite wood panel having a first and a second longitudinal edge comprising an essentially parallel first surface and second surface, a core, a spacer integrally formed in or attached in the core on at least the longitudinal edges wherein the spacer extends from an edge a pre-determined distance whereby upon placing one panel adjacent to a second panel a spacer of the first panel will abut a spacer of or an edge of a second panel thereby forming at least a first aperture between the adjacent panels wherein an aperture is located between adjacent edges of the panels. A spacer can push into its panel upon linear expansion of a panel. The spacer can be, e.g., a tongue, edge profile, or separate spacing material. Methods for making and using panels are disclosed.

27 Claims, 15 Drawing Sheets

U.S. PATENT DOCUMENTS 4,067,155 A 1/1978 Ruff et al.
4,068,437 A 1/1978 Byxbe et al.
4,095,913 A 6/1978 Pettersson et al.
4,142,931 A 3/1979 Viol et al.
4,183,324 A 1/1980 Nobbe
4,187,653 A 2/1980 Kliewer
4,218,856 A 8/1980 Irwin
4,301,634 A 11/1981 Shore et al.
4,337,607 A 7/1982 Boschetti
4,360,992 A 11/1982 Marino
4,437,274 A 3/1984 Slocum et al.
4,446,661 A 5/1984 Jonsson et al.
4,476,661 A 10/1984 Hoofe, III
4,517,147 A 5/1985 Taylor et al.
4,522,005 A 6/1985 Seaburg et al.
4,557,081 A 12/1985 Kelly
4,592,185 A 6/1986 Lynch et al.
4,605,467 A 8/1986 Bottger
4,635,413 A 1/1987 Hansen et al.
4,668,315 A 5/1987 Brady et al.
4,680,909 A 7/1987 Stewart
4,698,949 A 10/1987 Dietrich
4,703,603 A 11/1987 Hills
4,751,131 A 6/1988 Barnes
4,760,679 A 8/1988 Thompson
4,781,004 A 11/1988 Hartman
4,807,416 A 2/1989 Parasin
4,953,335 A * 9/1990 Kawaguchi et al. ..... 52/384
5,001,882 A 3/1991 Watkins et al.
5,042,214 A 8/1991 Howard
5,081,810 A 1/1992 Emmert
5,096,765 A 3/1992 Barnes
5,182,892 A 2/1993 Chase
5,261,204 A 11/1993 Neff
5,325,954 A 7/1994 Crittenden et al.
5,335,473 A 8/1994 Chase
5,344,700 A 9/1994 McGath et al.
5,348,778 A * 9/1994 Knipp et al. ..... 428/35.8
5,357,728 A 10/1994 Duncanson
5,367,846 A 11/1994 VonRoenn, Jr.
5,394,672 A 3/1995 Seem
5,433,050 A 7/1995 Wilson et al.
5,448,865 A * 9/1995 Palmersten ..... 52/309.9
5,457,917 A 10/1995 Palmersten
5,525,394 A 6/1996 Clarke et al.
5,635,248 A 6/1997 Hsu et al.
5,638,651 A 6/1997 Ford
5,664,386 A * 9/1997 Palmersten ..... 52/588.1
5,673,524 A * 10/1997 Gailey ..... 52/309.9
5,685,114 A 11/1997 Tanaka
5,685,118 A 11/1997 Simpson
5,694,730 A 12/1997 Del Rincon et al.
5,733,396 A 3/1998 Gerhardt et al.
5,762,980 A 6/1998 Bielfeldt
5,787,669 A 8/1998 Bishop
5,797,237 A 8/1998 Finkell, Jr.
5,934,037 A 8/1999 Bundra
5,950,389 A 9/1999 Porter
5,987,835 A 11/1999 Santarossa
6,009,679 A 1/2000 Larsen
6,035,910 A 3/2000 Schaefer
6,052,961 A 4/2000 Gibbs
6,058,671 A 5/2000 Strickland
6,085,480 A 7/2000 Baldwin
6,098,365 A 8/2000 Martin et al.
6,101,778 A 8/2000 Martensson
6,131,355 A 10/2000 Groh et al.
6,187,234 B1 2/2001 Bonomo et al.
6,415,575 B1 7/2002 Thompson
6,510,666 B1 1/2003 Thompson
6,532,709 B2 3/2003 Pervan
6,550,206 B2 4/2003 Lee
6,581,351 B2 6/2003 DeVivi
6,606,834 B2 8/2003 Martensson et al.
6,620,487 B1 9/2003 Tonyan et al.
6,647,638 B1 11/2003 Doyal
6,647,689 B2 11/2003 Pletzer et al.
6,658,808 B1 12/2003 Doherty et al.
6,662,517 B1 12/2003 Thompson
6,675,544 B1 1/2004 Ou et al.
6,682,254 B1 1/2004 Olofsson et al.
6,716,038 B2 4/2004 Garcia
6,730,841 B2 5/2004 Heckeroth
6,737,155 B1 5/2004 Ou
6,751,920 B2 6/2004 Thompson
6,751,923 B1 6/2004 Nunley
6,763,636 B2 7/2004 Dimitrijevic
6,769,218 B2 8/2004 Pervan
6,772,569 B2 8/2004 Bennett et al.
6,776,322 B2 8/2004 Villela et al.
D497,008 S 10/2004 Germany et al.
6,804,926 B1 10/2004 Eisermann
6,845,592 B2 1/2005 Voegele
6,865,856 B2 * 3/2005 Kim et al. ..... 52/592.1
6,922,965 B2 8/2005 Rosenthal et al.
2002/0108343 A1 8/2002 Knauseder
2002/0148551 A1 10/2002 Knauseder
2003/0009956 A1 1/2003 Manlove
2003/0132265 A1 7/2003 Villela et al.
2003/0145551 A1 8/2003 Grant
2003/0196399 A1 10/2003 Wu
2004/0020152 A1 2/2004 Harris, Sr.
2004/0178248 A1 9/2004 Villela et al.
2004/0187423 A1 9/2004 Weber
2005/0061943 A1 3/2005 Holden
2005/0194752 A1 9/2005 Klosowski et al.
2005/0229504 A1 10/2005 Bennett et al.
2005/0229524 A1 10/2005 Bennett et al.
2005/0252154 A1 11/2005 Martel et al.
2005/0257469 A1 11/2005 Bennett et al.
2006/0005499 A1 1/2006 Moriau
2006/0010818 A1 1/2006 Knauseder
2006/0010820 A1 1/2006 Schwitte

FOREIGN PATENT DOCUMENTS

JP 2001020505 1/2001
WO 7901138 12/1979
WO 9809036 3/1998
WO 0188299 11/2001
WO 0210525 2/2002

* cited by examiner

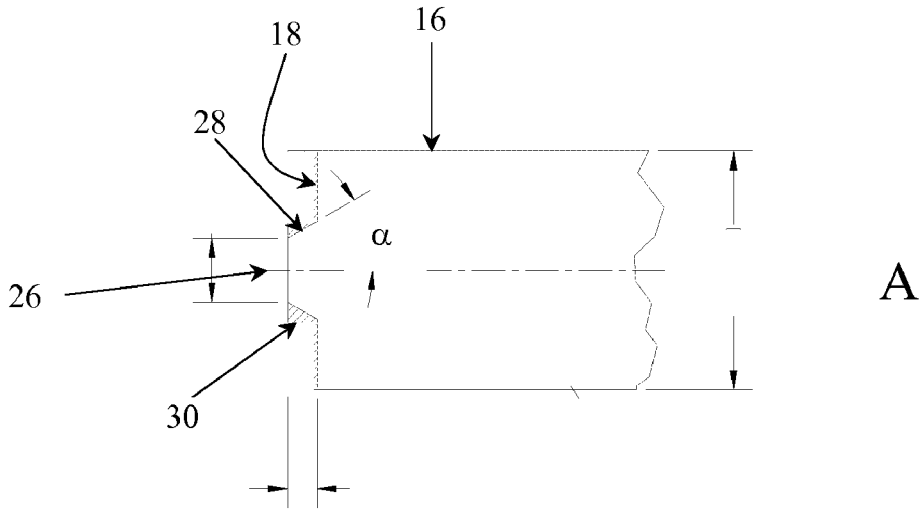
FIGURE 5
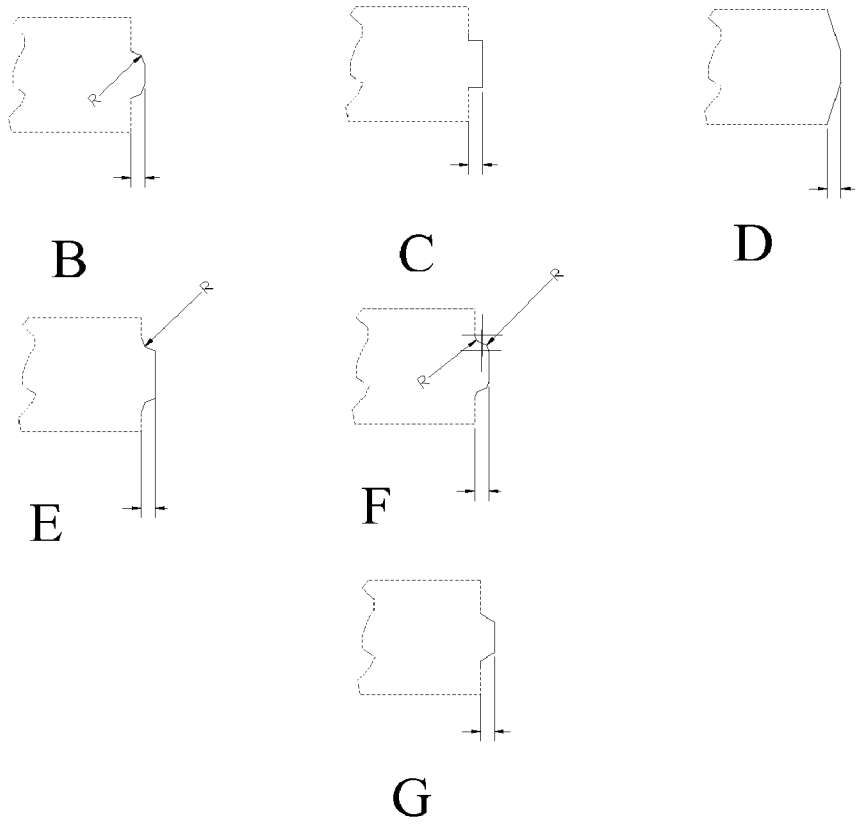

A

B

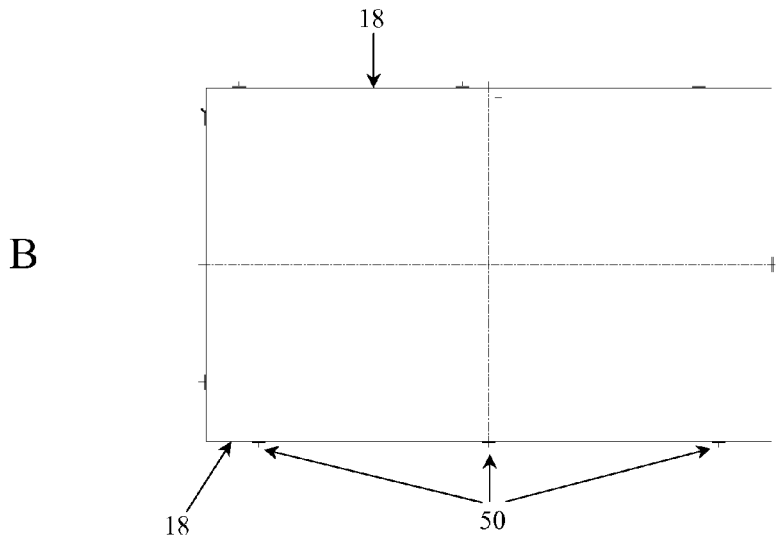
FIGURE 7
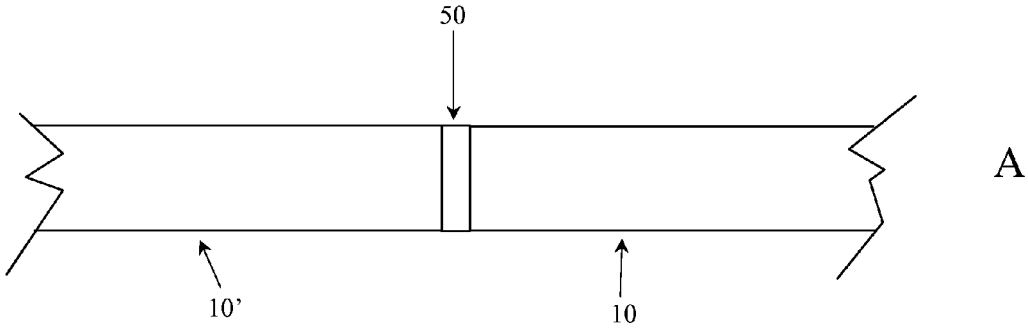

FIGURE 7 (con't.)
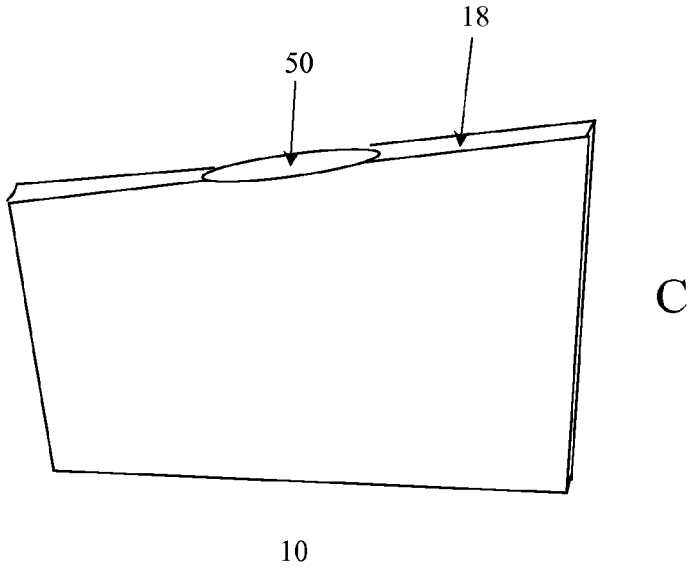
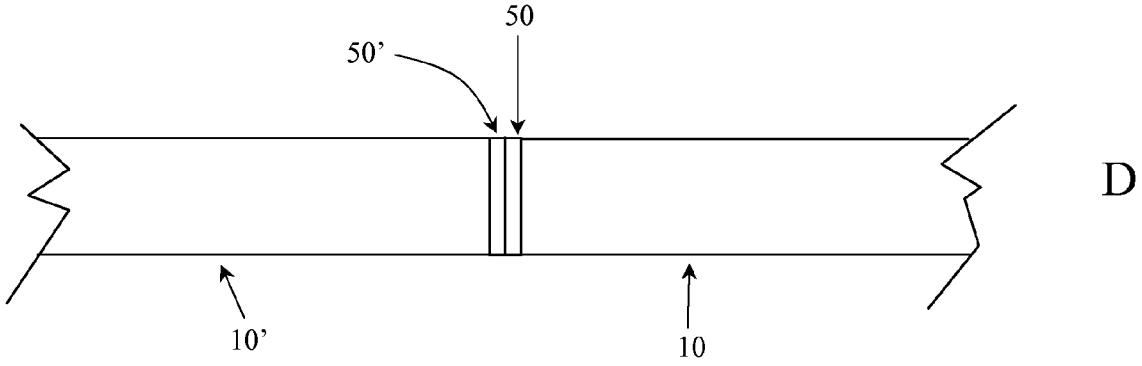

A

B

SELF-SPACING WOOD COMPOSITE PANELS

BACKGROUND

Construction materials must be installed correctly to insure the best performance. Wood-based panel products undergo dimensional changes when exposed to elevated moisture conditions. Most panels are put into service conditions at less than equilibrium moisture content. Consequently, there can be an uptake in moisture from the surrounding environment and "growth" in panel dimensions. The term used to describe this phenomenon is linear expansion (LE), whereby physical dimensions (length and width) will grow with moisture uptake.

There are a number of consequences to linear expansion when panels 1 are fitted tightly together at joints 3 prior to expansion (see, e.g., prior art FIGS. 1-3):

1) Panels 1 will buckle 4 somewhere along an unsupported span (FIG. 1).

2) Excessive deflection 5 may result (FIG. 2) in putting surfaces out of level.

3) The upper 8 and lower 9 surfaces (top and bottom faces) of the panel 1 will flare out 7 at the panel-to-panel joint 3 in a release of forces (FIG. 3). This flaring 7 of panel edges at joints 3 is sometimes attributed wholly to edges well, where the uptake of moisture causes expansion in the vertical direction, but is more likely to be a result of a combination of expansion in both directions. Flare-out 7 occurring prior to finishing the structure can necessitate sanding, adding additional cost to construction. Occurrence of edge flaring 7 after finishing can cause gypsum board (drywall) to crack, exterior siding to bulge out, floors or shingles to bulge out, etc.

4) Expansion of panels may push walls out of plumb; and 5) expansion of a wall system can push floors, ceilings, and roofs off level. In current panel construction, if enough LE occurs and the panel edges come into contact with each other, the compressive force on the surface flakes causes them to raise or "tent" up, causing ridging in the panel joint. This can cause shingles to telegraph the ridging, and can be a cause for customer complaint.

Given that the above expansion characteristics and consequent impacts are well known, most manufacturers, their third-party certification agencies, and governing standards prescribe a minimum gap at panel joints to allow for linear expansion. The amount of gap recommended is dependent on the inherent linear expansion character of the substrate (i.e., some panels will expand more than others).

The American Engineered Wood Association (APA) defines the panel spacing as the gap left between installed structural panels in floor, wall, or roof deck construction (http://wooduniversity.org/glossary.cfm, APA, 2006) and indicates that spacing distance should be enough to allow for any possible expansion due to changing moisture absorption levels to help prevent buckling and warping.

In general, when wood-based sheathing panels are installed, a ⅛" space between adjacent panel edges is recommended. Common techniques for spacing panels are simply to measure the gaps formed between deck boards as they are installed or to drive 8d or 10d nails into joints next to an installed deck board and place the next deck board against the nails. Previous methods for spacing include:

1) 8d or 10d box nails for gauging ⅛" spacing between panels or other spacers;

2) H-clip with spacing distance between adjacent panels (mechanical attachments); and 3) Panel edge profiling using a tongue and groove (T&G). A minimum ⅛" gap between square edged panels is recommended when the panels are applied to framing members. Often, the framers or roofers are not aware of the recommended ⅛" spacing for structural wall panels, and certainly, this is not common practice in the field. Some framers even believe that leaving the recommended space is a code violation. It is believed that excessive education and training are required regarding the need for ⅛" spacing if not using existing mechanical spacers such as H-clips or nails.

Most warranty claims and problems of the above nature presented to panel manufacturers arise from improper installation—the panels were not gapped as prescribed. Whether due to inexperienced installers, insufficient gapping from imprecise measurement tools, or time constraints in building schedules, proper gapping is not being done on all product installations.

Thus, problems associated with wood-based panels being installed without proper spacing has persisted for many years without solution. Consequently, a self spacing panel will be highly desirable for saving installation time and increasing value since the need for a separately installed spacer can be eliminated in the processes.

SUMMARY OF THE INVENTION

Described herein are self-spacing wood composite panels and systems thereof. Further described are methods for manufacturing and for assembling self-spacing wood composite panels.

In one aspect, described herein are self-spacing wood composite panels comprising spacers. The spacers can be integral with the panels. An integral spacer can be, for example, a tongue formed from at least a portion of a panel. Alternatively, spacers can be added onto the panels and made of different material than the panel.

Self-spacing panels having a first and a second longitudinal edge can comprise essentially parallel first and second surfaces, and an edge profile formed along each longitudinal edge whereby upon placing one self-spacing panel adjacent to a second self-spacing panel the edge profile of the first panel will abut the edge profile of a second panel thereby forming at least a first aperture between the adjacent panels wherein the aperture is located between adjacent edges of the panels above and/or below the abutting edge profiles.

In another aspect, described herein are systems or assemblies of self-spacing wood composite panels and a method for forming these systems or assemblies. Panels of the present invention can be assembled by simply placing them adjacent to one another (or adjacent to conventional panels). It is generally preferred that the self-spacing panels are placed such that the spacers of the panels are abutting an edge of an adjacent panel or a spacer of an adjacent panel.

Also described herein is a method for forming an assembly of panels, for example, a wall, floor, or roof, comprising self-spacing composite wood panels of the invention. The method can comprise placing the self-spacing panels with the spacers abutting or spaced further apart from each other at desired spacing. A method of the invention can further comprise providing or manufacturing wood composite panels with desirable spacers on an edge of a panel.

The invention includes a composite wood panel comprising a first and second longitudinal edge, wherein at least the first and second longitudinal edges comprise a spacer for spacing of adjacent wood composite panels. The spacer can comprise a tongue, and the tongue can have, e.g., two sides and a head extending outward from the longitudinal edge, thereby forming a juncture between the head of one tongue and the head of a second tongue when panels are placed adjacent to one another. The tongues are located such that upon assembly of two wood composite panels the tongues will abut, thus, preventing the edges from initially abutting. An aperture is formed between the adjacent longitudinal edge of each panel both above and below the abutting tongues. The spacer can alternatively comprise an added device or material, e.g., adhesive bead, bumpon, tack, or stapled spacer, and abut an edge or other spacer on a second panel, thus, forming at least one aperture above and/or below the spacer.

The aperture(s) allow for subsequent expansion and swelling along the edge(s) of the adjacent panels. In particular in the tongue embodiment, the tongues can compress into the edge as the adjacent panels expand, thereby reducing stress along the edges of the adjacent panels and preventing or reducing stress on the longitudinal edges and faces of the panels.

The invention provides composite wood panels which can be utilized in an assembly with reduced or free of buckling, bowing or cracking resulting from stress and pressure along adjacent composite wood panel edges. The spacing design/assemblies disclosed herein provide a free or controllable expansion space for relieving the forces of expansion of sheathing so that ridging, warping, buckling, and other damage to floor, roof and wall systems can be eliminated.

Additional advantages will be set forth in part in the description which follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE DRAWINGS

The accompanying drawings, which are incorporated in and constitute a part of this specification, illustrate several aspects described below. Like numbers represent the same elements throughout the figures.

FIG. 5 is a side view of various example tongue profiles for a T&T panel of an article of the invention.

FIG. 7 is side views of an adhesive joint (FIG. 7A, 7D), a top view of a panel with non-continuous adhesive bead spacers around the panel edges (FIG. 7B), and a perspective view of a spacer on an edge of a panel (FIG. 7C) in accordance with an example embodiment of an assembly of and an article of the invention.

FIG. 11A is a side view of the apparatus for a drop test. FIG. 11B is a front view of a panel staged to be dropped on the drop test apparatus.

DETAILED DESCRIPTION

Figure 1:
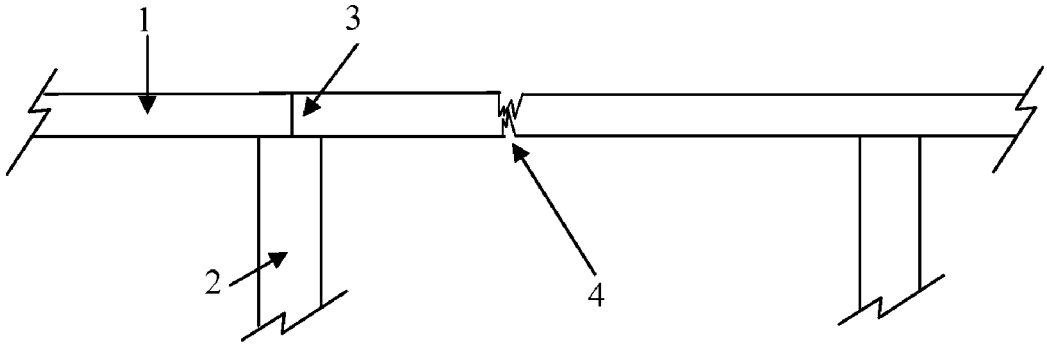
(PRIOR ART) FIGURE 1
FIG. 1 illustrates a buckling panel from linear expansion (LE) of panels at a joint in the prior art.
Figure 2:
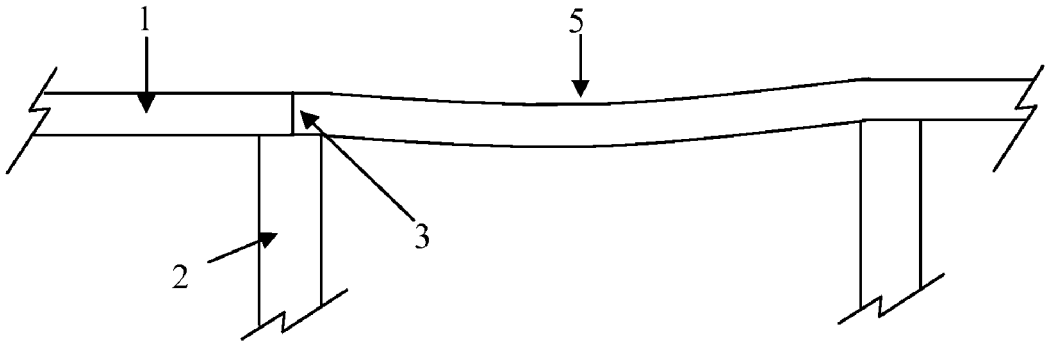
(PRIOR ART) FIGURE 2
FIG. 2 illustrates excessive deflection of panels from LE in the prior art.
Figure 3:
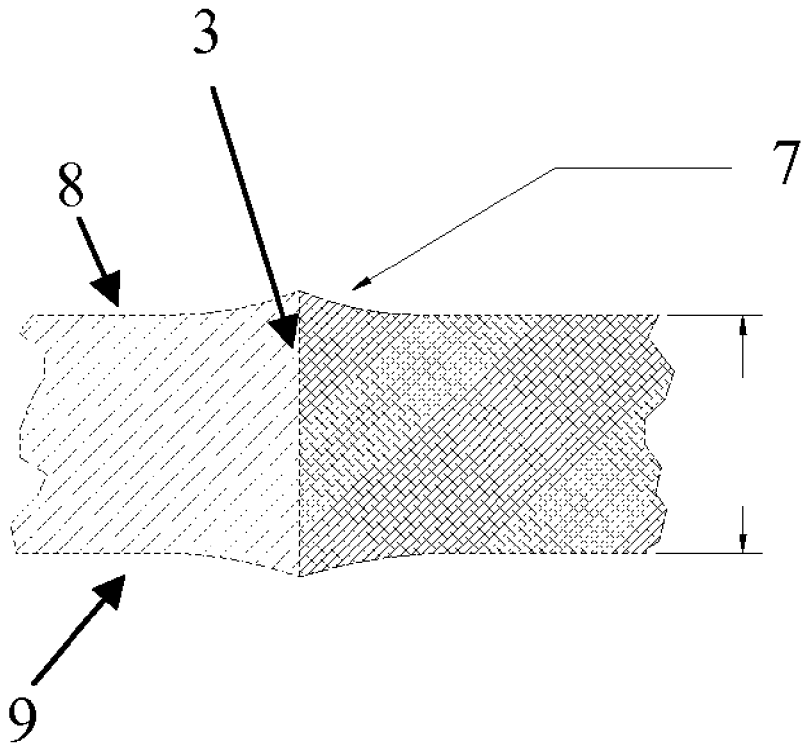
(PRIOR ART) FIGURE 3
FIG. 3 illustrates a flare-out of panels from LE at a joint in the prior art.

Before the present articles, devices, and/or methods are disclosed and described, it is to be understood that the aspects of the invention described below are not limited to the specific example embodiments described, as embodiments of the invention may, of course, vary. It is also to be understood that the terminology used herein is for the purpose of describing particular aspects only and is not intended to be limiting.

In this specification and in the claims which follow, reference will be made to a number of terms which shall be defined to have the following meanings:

It must be noted that, as used in the specification and the appended claims, the singular forms "a," "an," and "the" include plural referents unless the context clearly dictates otherwise. Thus, for example, reference to "an edge" includes more than one edge, reference to "a face" includes two or more such faces, and the like.

"Optional" or "optionally" means that the subsequently described event or circumstance may or may not occur, and that the description includes instances where the event or circumstance occurs and instances where it does not.

Ranges may be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Core" or "core area," as used herein, refers to an area of a panel made of the innermost layers of flakes or wood components; it is the area closest to the center and generally having flakes oriented perpendicularly to the surface flakes in panels with 3 layers (e.g., the middle layer in a three layer board) and with flakes in a parallel orientation in panels with 5 layers (e.g., the third layer in a five layer board with layers two and four being "intermediate" layers). In a panel with 4 layers, the inner two layers would be "core" layers.

"Face area" or "surface area," as used herein, refers to the areas of a panel made of the outermost layers, or furthest from the center layers of flakes or other wood components in a construction of a panel, e.g., the layer comprising flakes oriented in the longitudinal direction of the panel constitutes a face layer.

By "wood composite" material it is meant a composite material that comprises wood and one or more other additives, such as adhesives or waxes. Non-limiting examples of wood composite materials include oriented strand board ("OSB"), waferboard, particle board, chipboard, medium-density fiberboard, plywood, and boards that are a composite of strands and ply veneers. As used herein, "flakes," "strands," and "wafers" are considered equivalent to one another and are used interchangeably. A non-exclusive description of wood composite materials may be found in the Supplement Volume to the Kirk-Othmer Encyclopedia of Chemical Technology, pp. 765-810, $6^{th}$ Edition.

A self-spacing panel of the invention allows an assembly (or array) of building panels to be laid adjacent edge to edge on a support structure with a gap between the edges. This automatic gapping allows the panels to grow lengthwise and widthwise without negatively affecting surrounding panels. The self-spacing system allows the installer to consistently achieve an engineered gap, thus, providing a better end product to the consumer.

A. Articles

In one aspect, described herein are self-spacing panels. The self-spacing panels can take the form of various embodiments and can be formed in various ways.

The self-spacing panels having a first and a second longitudinal edge can comprise essentially parallel first and second surfaces, an edge profile formed along each longitudinal edge whereby upon placing one self-spacing panel adjacent to a second self-spacing panel the edge profile of the first panel will abut the edge profile of a second panel thereby forming at least a first aperture of a pre-determined distance between the adjacent panels wherein the aperture is located between adjacent edges of the panels above and/or below the abutting edge profiles. A self-spacing panel edge profile can comprise an integral tongue formed along each longitudinal edge in a core area of the panel wherein the tongue extends from the edge a pre-determined distance whereby upon placing one self-spacing panel adjacent to a second self-spacing panel a tongue of the first panel will abut a tongue of a second panel thereby forming a first and a second aperture between the adjacent panels wherein the apertures are located between adjacent edges of the panels above and below the abutting tongues and wherein the tongue pushes into the panel from which it was formed upon expansion of the panel(s).

Alternatively, a self-spacing panel edge profile can comprise a bevel formed along each longitudinal edge of the panel wherein the bevel extends from the edge a pre-determined distance whereby upon placing one self-spacing panel adjacent to a second self-spacing panel a bevel of the first panel will abut a bevel of a second panel thereby forming an aperture between the adjacent panels wherein an aperture is located between adjacent edges of the panels above or below the abutting bevels.

In another embodiment, self-spacing panels having a first and a second longitudinal edge can comprise essentially parallel first and second surfaces, at least one spacer attached along each longitudinal edge wherein the spacer extends from the edge a pre-determined distance whereby upon placing one self-spacing panel adjacent to a second self-spacing panel a spacer of the first panel will abut a spacer or an edge of a second panel thereby forming an aperture between the adjacent panels wherein the aperture is located between adjacent edges of the panels. The spacer can be attached, for example, in the core area of the panel. The spacer can comprise a deformable or a rigid device.

Self-spacing panels of the invention can comprise a wood composite. Composite wood panels are ligno-cellulosic wood composites comprising multiple wood parts (e.g., wood strands, flakes, particle chips dust, etc.) bonded together with a thermoset binder resin and wax. In particular, an example wood composite is oriented strand board, such as described in U.S. Pat. Nos. 5,525,394 and 5,635,248, herein incorporated by reference in their entireties.

Embodiments of articles of the invention can be formed on regular wood composite panels as well as specialty panels such as the overlaid panels described in, e.g., in U.S. Pat. Nos. 6,737,155 and 6,772,569 and U.S. Published Applications 2005/0229504, 2005/0257469, and 2005/0229524, hereby incorporated by reference for their teachings on overlaid panels.

Additional materials can comprise a joint between panels. For example, a seam sealing tape, caulk, or the like can be placed over or in an aperture between the panels.

Various example embodiments of an article of the invention include the following:

"Tongue and Tongue" Self-Spacing

Figure 4:
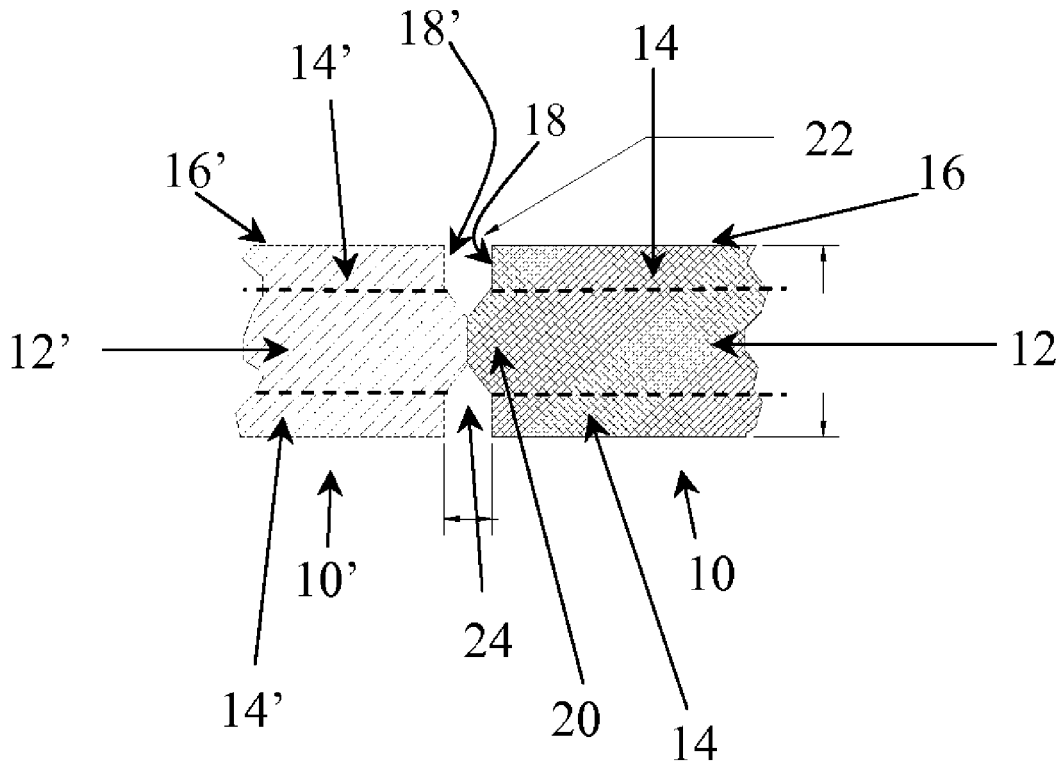
FIG. 4 is a cross-sectional view of a tongue and tongue (T&T) joint in accordance with an example embodiment of an assembly of the invention.

In an example embodiment, the invention includes a tongue and tongue (T&T) wood composite panel, plank, or board, e.g., those for use in walls, roofing, flooring, subflooring, wall boards, decks, countertops, or any other suitable surface wherein the wood composite panels employed are subject to undesired swelling or expansion which may create pressure or stress along panel joints. An example embodiment is shown in FIG. 4—a panel 10 comprises a core area 12 and two surface areas 14. The panel 10 further comprises two faces 16 and four edges 18. A tongue (or spacer) 20 is formed in at least one edge 18 in a core section 12 of the panel 10. The edge 18 with a tongue 20 can be a longitudinal edge.

FIG. 4 illustrates a cross-sectional profile of a T&T joint. Referring to FIG. 4, a wood composite board or panel 10 is provided with a tongue (or spacer) 20 on one edge 18 and a second board or panel 10' is provided with a tongue 20' on a second edge 18' facing and abutting the first tongue 20. The tongue 20 is formed such that it extends from the edge 18 a pre-determined distance. Thus, when the boards or panels 10 and 10' are laid adjacent to one another thereby forming a joint, the edge 18 of panel 10 above and below the tongue 20 and the edge 18' of panel 10' above and below the tongue 20' do not abut each other but instead form an aperture (or space or gap) 22, 24 of a desired distance. A first aperture 22 is formed between edges 18, 18' of panels 10 and 10' above the abutting tongues 20, 20', and a second aperture 24 is formed between the edges 18, 18' of panels 10 and 10' below the abutting tongues 20, 20'. FIG. 4 illustrates a cross-sectional profile of a T&T joint formed by abutting similar T&T composite wood panels in accordance with an example embodiment. A first wood composite board or panel 10 is provided with a tongue (or spacer) 20 along a first longitudinal edge 18 and a second board or panel 10' is provided with tongue 20' along a second longitudinal edge 18' facing the first tongue 20. The tongue 20 can have a head 26, an upper wall 28, and a lower wall 30 extending outward from a longitudinal edge 18 (FIG. 5A). A tongue 20 can extend uninterrupted along the entire length of the longitudinal edge 18, or in the alternative, the tongue 20 can be segmented to allow for, e.g., water to pass in between the tongue segments. The tongue 20 can be of a discrete width.

When abutting self-spacing panels of the present invention are subjected to moisture, the panels tend to expand. Since the panels are not rigidly interconnected at a joint, there is an opportunity to reduce resulting stress along the edges and consequently the boards or panels will not buckle or bow. The present invention overcomes at least some deficiencies in the prior art by providing an area for panel expansion both above and below the abutting tongues.

The dimensions of a spacer 20 can be determined by one of ordinary skill in the art. The length of the spacer is generally one-half of the desired gap between the panels. This length can depend upon the composition of the panel and the expected conditions to which the panel will be exposed. The thickness of the spacer preferably is co-extensive with the core area of the panel or thinner than the core area of the panel, for example, 0.10" or 0.17", e.g., 0.10", 0.12", 0.14", 0.15", 0.16", 0.17". The width of the spacer can be up to the entire edge of the panel upon which it is formed. The width can be less than the entire edge. Multiple tongues can be of varying widths on the same panel.

In one example embodiment, tongue length is 1/16" for a 1/8" gap between panels. Successful (i.e., desired results of less ridging than conventional panels) tongue thicknesses from testing (see, e.g., Examples below) ranged from about 0.10" to about 0.17" for a 0.5" thick panel. For thicker and thinner panels, it is recommended that the tongue thickness be adjusted proportionally to the change in panel thickness.

A tongue 20 is formed so that it is located in a core section 12 of the panel 10 along a longitudinal edge 18. As a result, the tongue 20 is believed to compress into the core area 12 of the panel 10 in which it is formed as a result of the force applied by an adjacent tongue 20' on an adjacent longitudinal edge 18' when the panels expand. In this way, the adjacent wood composite panels may expand slightly, allowing the panels to absorb moisture without bowing or cracking along the edges of the panel or flaring the faces of the panel. The expansion of the panels may continue until the edges of the adjacent panels come into contact or until the tongue is unable to push into the panel any further. It is preferred that the tongue be of such size and shape that, should expansion of adjacent panels occur, the tongue can compress under the pressure of the expansion without visible damage or modification at the panel surface. Further, the tongue can be of any shape or form and can be provided at any convenient place(s) along the longitudinal edge.

It is believed that during expansion of the panels that the tongues primarily push into the core of the panel on which they are formed as opposed to deforming the adjacent panel.

FIG. 5 illustrates cross-sectional profiles of further example embodiments. Particularly, the tongue takes various shapes as alternatives to the tongue illustrated in FIG. 4.

The tongue of the T&T embodiment can be further utilized along the width (or transverse edge) of two adjacent wood composite panels. Accordingly, a wood composite panel can comprise a tongue along a first longitudinal edge and a first width edge which tongues can abut a tongue along a second panel's longitudinal edge or width edge. As a result, adjacent wood composite panels can abut with joints along all four edges of the panels. In this way, adjacent wood composite panels may swell along both their length and width, without undesired stress and pressure along the panel edges. Optionally, tongue and tongue joints can be placed, or be absent, along any of the four edges of the panels, in any order or fashion, as needed by the user.

Normally, a T&T self-spacing embodiment can have a tongue manufactured integrally on the panel edge(s) in the production facility that makes the panel, but this profiling could be done secondarily. The profile would preferably be the same on any edge which has a profile.

One of the advantages of this T&T embodiment, specifically in the case of the T&T profile on the longitudinal edge of an OSB panel, is that due to the orientation of the core flakes, the LE of the core is significantly lower than the LE of the surfaces. This allows the surfaces of the panel to expand, since the cores of the panels are in contact at installation. Another advantage of the embodiment is the robust nature of the profile, which is resistant to shipping and handling damage, and since it can be continuous across the entire edge of the panel, if some damage were to occur at certain points along the edge, the rest of the T&T would be in contact, thus, preserving the function of maintaining the gap at the surfaces. Another advantage to the embodiment is that both edges of the panel can be symmetric, allowing the panel to be placed without regards to which edge goes against which edge, or in other words, any longitudinal (e.g., 8') edge will match up with any other longitudinal (e.g., 8') edge, without respect to panel orientation.

Another advantage to this embodiment is the quick and low-cost adaptation of current tenoner equipment in the plant to produce the profile on panel edges. The only thing needed is new cutter heads and changeover adjustments on the equipment, and it can be set up to run in plants in a short time period and at low cost.

Upon assembly of a roof, wall, floor, or the like, a first panel 10 and a second panel 10' will have abutting tongues 20, 20' but prevent the edges 18, 18' from initially abutting. In an example embodiment of an assembly of panels, the first and second apertures 22, 24 are at least about 1/8" wide for wood composite panels having a thickness in the range of 0.25 (1/4") to 1.5 (1/2") inches. However, a smaller or larger aperture can be utilized depending on the composition of the panels and the expected exposure to moisture. In this way, the edges of the adjacent wood composite panels do not form a tight joint along the panel edge, and the apertures allow for expansion of the adjacent wood composite panels.

"V-Shape" Self-Spacing

Figure 6:
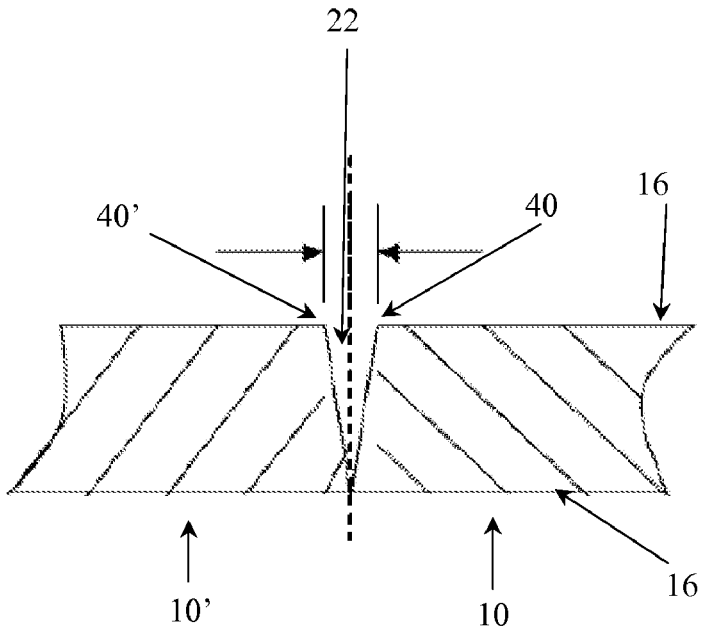
FIG. 6 is a cross-sectional view of a V-shape joint in accordance with an example embodiment of an assembly of an article of the invention with a self-spacing edge profile.
Figure 6:
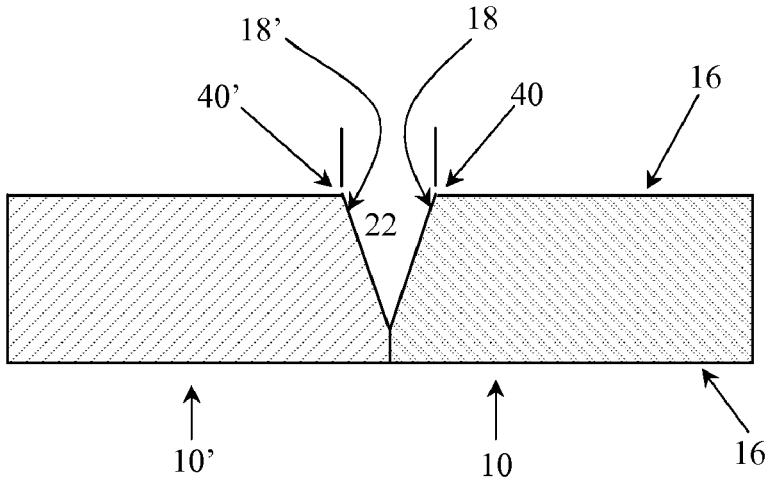

Another example embodiment for providing a gap (or aperture) between self-spacing panels can be created by forming an edge profile 40 such as by beveling at least one edge 18 as shown in FIG. 6 ("V-shape"). The bevel 40 shape/angle can be changed to provide different spacing 22 between surfaces 16, as desired. The bevel 40 does not need to extend all the way from the top surface 16 to the bottom surface 16. The bevel 40 can be stopped, for example, from about 1/3 to about 9/10 of the way through the panel 10 from the top surface 16. One example of this is shown in FIG. 6B.

In another example embodiment, an article of the invention comprises a self-spacing panel 10 having a first 18 and a second longitudinal edge 18 comprising essentially parallel first 16 and second surfaces 16, an edge profile 40 formed along at least one longitudinal edge 18 whereby upon placing one self-spacing panel 10 adjacent to a second self-spacing panel 10' the edge profile 40 of the first panel 10 will abut the edge profile 40' of a second panel 10' thereby forming at least a first aperture 22 between the adjacent panels 10, 10' wherein the aperture 22 is located between adjacent edges 18 of the panels 10, 10' above and/or below the abutting edge profiles 40, 40' (see, e.g., FIG. 6).

The shape and dimensions of the bevel edge profile can be determined by one of ordinary skill in the art. The profile (e.g., bevel) can be formed using panel edge profile-forming techniques generally known by one of ordinary skill in the art.

Adhesive Spacer

An example embodiment of a self-spacing panel of the invention can include a wood composite panel 10 comprising a separate compressible and/or deformable spacer 50 attached to at least two edges 18 of the panel. The separate compressible and/or deformable spacer 50 can comprise an adhesive. See e.g., FIG. 7.

The self-spacing panels 10 can comprise a panel having first and second longitudinal edges 18 comprising essentially parallel first and second surfaces 16, at least one spacer 50 attached along each longitudinal edge 18 wherein the spacer 50 extends from the edge a pre-determined distance whereby upon placing one self-spacing panel 10 adjacent to a second self-spacing panel 10' a spacer 50 of the first panel 10 will abut an adjacent longitudinal edge 18' of a second panel 10' (see, e.g., FIG. 7A) wherein the spacer 50 will deform or compress upon expansion of the panel(s) 10, 10'. In this example embodiment, the spacers can be in discrete locations and staggered such that they do not abut another spacer when panels are placed adjacent to one another (see, e.g., FIG. 7B). Alternatively, a spacer 50 can abut another spacer 50' when panels are adjacent to one another (e.g., spacer continuous and on all four edges of a panel) (see, e.g., FIG. 7D).

A self-spacing adhesive embodiment can comprise a deformable bead of adhesive 50 that is applied on the edges 18 of a panel 10. The bead can be applied to any number of edges of the panel. The bead can be continuous or in discrete portions along the edge.

An example adhesive tested was Multi Lok® 50-12611 hot melt (proprietary polyamide based thermoplastic adhesive; Forbo Adhesives LLC, Swift 84114 manufactured by Swift Products Research Triangle Park, N.C.). Another example adhesive tested was a High Crystallized Ethyl Vinyl Acetate 84144 (Forbo Adhesives, manufactured by Swift Products). See Examples. However, any material that can be extruded to make a deformable bead, e.g., silicone or latex caulk, can be used for this application. Hot melts are the preferred materials since others may set-up in a machine during manufacturing delays or while not in use due to manufacture of other products or may not be as durable after application.

The adhesive bead can be essentially the same on all edges (e.g., 8' edges and 4' edges) so that when panels are placed adjacent to each other, the edges that come in contact with each other will be gapped a pre-determined distance (e.g., ⅛") apart by an adhesive bead. For ease of manufacturing, the bead size or length does not need to vary with product thickness. However, the bead size can be adjusted to be between about 25 and about 75% of board thickness. The pattern of the adhesive can be applied so that no matter how a panel is turned, a pre-determined gap would result between the panels. See e.g., FIG. 7.

The adhesive beads can contact each other or contact a panel edge without adhesive and deform as the panel grows due to environmental factors. During manufacturing the beads of adhesive can be applied robotically to the edges while the boards are in stacked unit form.

It is believed that adhesives have not been used before on panels for their deformable properties as opposed to their adhesive properties. An advantage of adhesives being used as in the manner of the current invention is their ability to be recycled in a wood products process and their ease of application.

"Add-On" Spacers

An example embodiment of a self-spacing panel 10 of the invention can include a wood composite panel comprising a separate rigid spacer 60 attached to at least two edges 18 of the panel 10. A spacer 60 can serve as an object or stopper that actually controls the gap distance (or aperture) between adjacent edges of panels when the panels are installed. A spacer should have enough rigidity to maintain a desired gap initially, but enough compressibility to deform without damaging the surfaces of a panel after LE. The spacer also should be attached securely to a panel edge so it will not fall off or get knocked off during shipping, handling and installation.

Self-spacing panels 10 can comprise a panel having first and second longitudinal edges 18 comprising essentially parallel first and second surfaces 16, at least one spacer 60 attached along at least two longitudinal edges 18 wherein the spacer 60 extends from the edge 18 a pre-determined distance whereby upon placing a first self-spacing panel 10 adjacent to a second self-spacing panel 10' a spacer 60 of the first panel 10 will abut a spacer 60' of a second panel 10' thereby forming an aperture (22 and/or 24) between the adjacent panels 10, 10' wherein an aperture (22 and/or 24) is located between adjacent edges 18 of the panels 10, 10'. An aperture can be above and/or below the abutting spacers 60, 60'. The spacer 60 can be attached, for example, in the core area 12 of the panel 10. Alternatively, a spacer 60 of the first panel 10 can abut an edge 18' of the second panel 10' thereby forming at least a first aperture 22 between the adjacent panels 10, 10'.

A separate resilient, but semi-rigid, spacer 60 can comprise, for example, a 3M™ Bumpon™ (model SJ-5008, tapered square 0.5" wide×0.12" high, 8×10 matrix form, 3M, St. Paul, Minn.) pressure sensitive adhesive-backed polyurethane spacer device thereon. According to a 3M™ Bumpon™ information sheet, the example Bumpon™ SJ-5008 has properties as follows:

TABLE 1

Bumpon ™ SJ-5008 properties.

| Property | Test Method | Value |
|---|---|---|
| Hardness, Shore A | ASTM D2240 | 70 |
| Resilience, % | ASTM D2632 0.125" sample | 30 |
| Kinetic Coefficient of Friction (Mk)(Dependent on test surface) | ASTM D1894 wood | 0.9-1.4 |
| Abrasion resistance (Taber H18, 1 kg) g/1000 cycles | ASTM C501 | 1.7-1.9 |
| Tensile, lbs/in (MPa) | ASTM D412, Die A | 600 (4.1) |
| Elongation, % | ASTM D412, Die A | 100 |
| Dielectric strength, V/mil | ASTM D1000 | 200 |
| Stain resistance | 3M-24 hrs @ 158° F. against white paint, 7 days exposed to UV | No staining |
| Flammability listing | UL 94HB | Pass: UL recognized |

Figure 8:
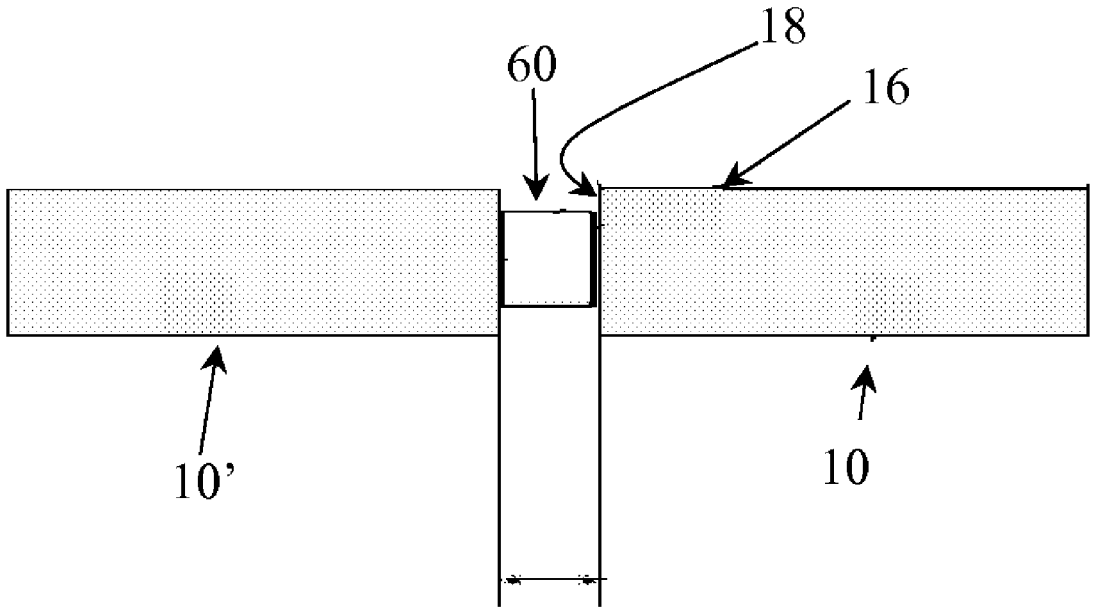
FIG. 8 illustrates a side view of a "bump-on" joint in accordance with an example embodiment of an assembly of the invention.

See e.g., FIG. 8. Other elastomeric spacers with the same functionality will work as well. The functions the spacer serves include providing an initial pre-determined gap between the panels and "giving" enough to decrease (relative to panels installed without spacers) or prevent damage from LE on the faces of a wood composite panel.

Figure 9:
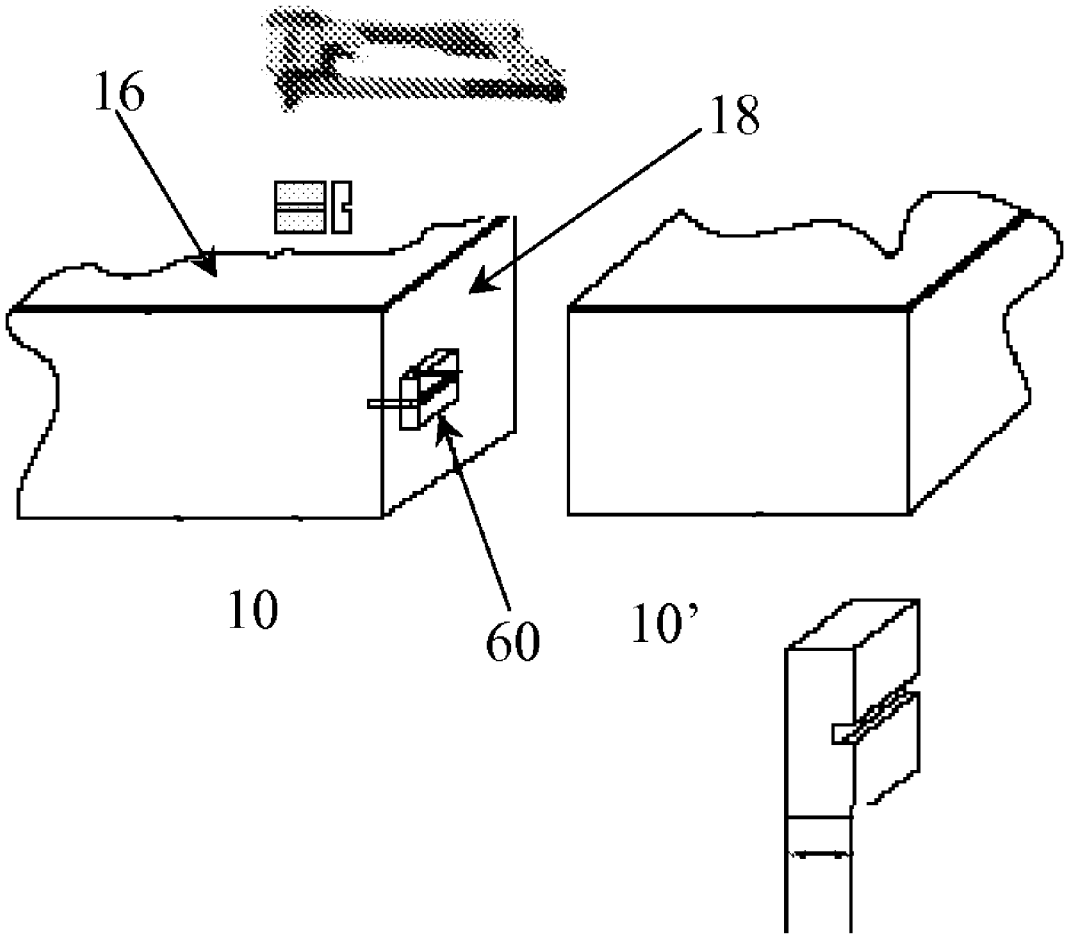
FIG. 9 is a perspective view of a staple spacer on a panel edge and a close-up perspective of a plastic spacer in accordance with an example embodiment of an article of the invention.

In another example embodiment, a separate semi-rigid spacer 60 can comprise, for example, a staple or a staple with a plastic spacer device thereon. See e.g., FIG. 9. A staple can hold a plastic spacer in place, the staple being, for example, preferably a composite staple or metal-composite staple. In an example embodiment, a 3M™ Bumpon™ (described above) was stapled to a panel using a conventional staple (e.g., Raptor® Engineered polymer composite staple, S/05-55, ½" crown, 9/16" length, 0.045" thickness, Round Rock, Tex.) and a conventional handheld staple gun. In the example tested embodiment, the staples were located along the longitudinal 8' edges of an OSB panel at 18" in from a corner, the second 47" from the corner, and the third 76" from the same corner.

Figure 10:
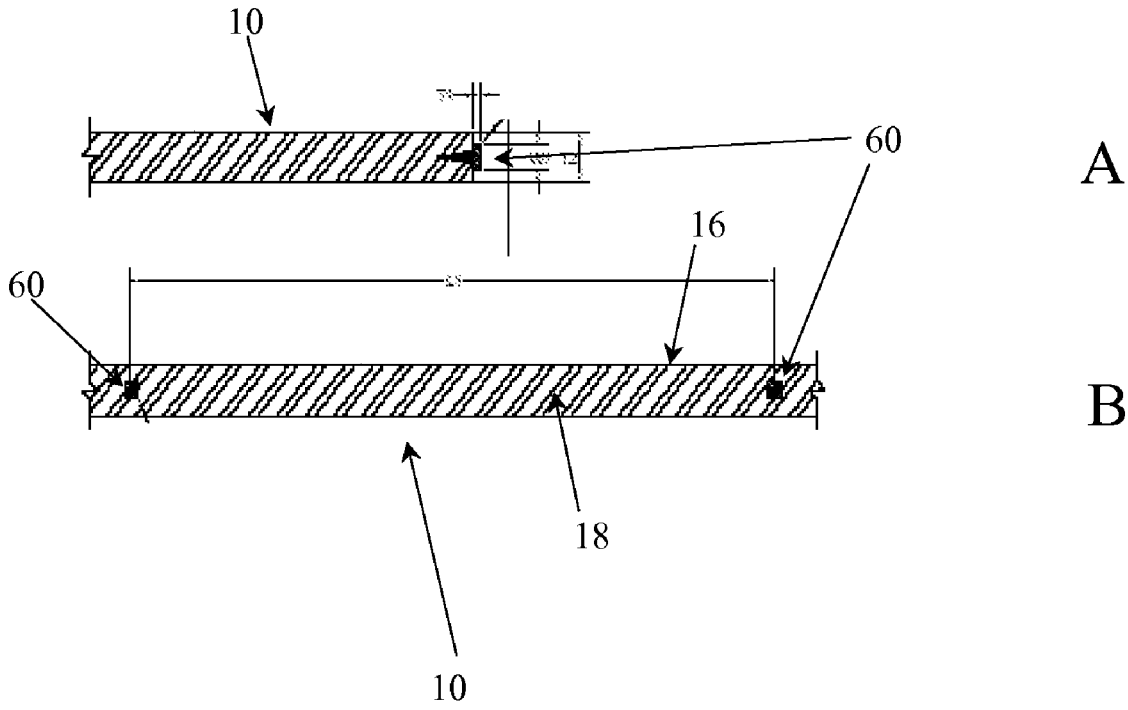
FIG. 10 is a cross-sectional view (FIG. 10A) and an edge view (FIG. 10B) of a tack spacer panel in accordance with an example embodiment of an article of the invention.

In a further embodiment, a separate rigid spacer 60 can comprise, for example, a tack with a cap. See e.g., FIG. 10. A tack can be, e.g., preferably a composite material which will hold securely to the panel edge, the thickness of the head of the tack giving the desired spacing (e.g., conventional upholstery tacks, 0.375" diameter, head 0.18" tall, rounded in shape, spike 0.4" long with a diameter of 0.045"). The size of the height and width of the head of the tack allow sufficient surface area to hold a desired panel gap initially then compress into the panel edge upon LE. The tack can be applied using conventional techniques, such as a tack hammer. In the example tested embodiment, the tacks were located along the longitudinal 8' edges of an OSB panel at 18" in from a corner, the second 47" from the corner, and the third 76" from the same corner.

System or Assembly of Panels

The invention includes an assembly (or array) of self-spacing panels of the invention. The panels, described above, can be assembled in a manner quite similar to conventional wood composite panels without self-spacing features. One of ordinary skill in the art is familiar with these assemblies. Panels of the present invention can be assembled by simply placing them adjacent to one another (or adjacent to conventional panels). It is generally preferred that the self-spacing panels are placed such that the spacers of adjacent panels are abutting one another. Alternatively, additional spacing (gap) can be left between panels as long as that gap is still effective for the purposes of the assembly of panels (e.g., floor, wall, or roof) and not detrimental to those end purposes.

The panels can be anchored to a support structure using conventional techniques known to one of ordinary skill in the art, e.g., nailing or screwing.

Once assembled, additional materials can be added to the panels. For example, a joint between panels can further comprise, e.g., a seam sealing tape, caulk, or the like. Such additional materials can be placed over or in an aperture between the panels. One of ordinary skill in the art can determine appropriate materials and corresponding installation methods.

B. Methods

Methods for making the articles above are known to one or skill in the art or can be readily discerned by one of ordinary skill in the art. The panels described herein can be readily manufactured using techniques generally known to those of ordinary skill in the art. Suitable methods for making panels are described in, e.g., Engineered Wood Products, PFS Research Foundation, Stephen Smulski (ed.), 1997, ISBN 096567360X, which is hereby incorporated by reference in its entirety.

Example Manufacturing Method for an Adhesive Spacer Embodiment

Application of a hot melt adhesive to a wood composite panel is preferably performed after the wood composite panels are sent through the finishing line and are unitized. This prevents the hot melt from being wiped off or damaged during conveying and processing at the finishing line. Further, the temperature of the board may be too high to apply in an in-line fashion, but this will depend on the specific process, i.e., delay between pressing and application of the hot melt bead, the type of hot melt adhesive, etc. Thermal imaging and testing indicated that the adhesive can fall off or be wiped off before it hardens. (A Flir ThermaCam E2 IR camera was used to determine temperature of the panel at the grade line station in process which indicated the board temperature was too high to apply the adhesive effectively, i.e., there was insufficient thermal gradient to allow the hot melt to solidify.) The presently intended location to apply the hot melt is within a paint booth where, e.g., an edge sealant is applied. A separate 6-axis robot (e.g., Willamette Valley Company, model UP20-M, Eugene, Oreg.) outfitted with a gang of hot melt guns could, for example, automatically apply a desired pattern (e.g., a ⅛" wide bead applied along the edge in unit form) of the hot melt. The guns can be supplied, for example, by Nordson Corporation (Westlake, Ohio, model BM 200 supply unit with Minibead guns). Edge sealant, if any, can be applied on top of the hot melt.

Method of Assembling

The invention includes an assembly of panels. A method of forming a panel assembly can comprise placing the self-spacing panels of the invention with the spacers abutting (or spaced further apart from each other) at desired spacing. A method of the invention can further comprise providing or manufacturing wood composite panels of the invention with desired spacers on an edge of a panel. For example, regular OSB can be profiled with a special edge profile (T&T). Alternatively, a separate spacer can be attached following the edge trimming of regular panel manufacturing processes.

A method of assembling a roof, wall or floor from the panels can further comprise attaching the panels to a support structure. A support structure can be, for example, framing comprised of studs. The method can further comprise taping joints between the self-spacing panels with a seam sealing tape. (e.g., ZIP System™ sealing tape, Huber Engineered Woods, LLC, Charlotte, N.C.; http://huberwood.com/zip/zipwall/index.htm; http://huberwood.com/zip/ziproof/index.htm).

An advantage of the above process includes saving labor and installation time with the elimination of steps of installing separate spacers, e.g., H-clips or nails.

C. Utility

The panels and assemblies thereof can be used in a variety of applications. For example, walls, floors, and roofs are well-suited to be made from panels of the present invention. Panels of the invention are especially well-suited for those places most exposed to moisture conditions responsible for linear expansion of wood composite panels.

EXAMPLES

The following examples are put forth so as to provide those of ordinary skill in the art with a complete disclosure and description of how the articles, devices, and/or methods described and claimed herein are made and evaluated, and are intended to be purely exemplary and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. Only reasonable and routine experimentation will be required to optimize articles and/or methods of the invention.

Example 1

T&T Spacer Drop Test

Panels of 4'×8'×½" ZIP™ sheathing (Huber Engineered Woods, LLC, Charlotte, N.C.) were machined to produce a 1/16" wide 2" long tongue edge profile as shown in FIG. 5A ($\alpha$=30°) on the 8' edge of the panel 18" from each end (two tongues on the edge) using conventional tenoner equipment. Two different tongue heights—0.10" and 0.17" as measured along the flat end of the tongue—were machined and tested.

Drop Test Procedure

Figure 11:
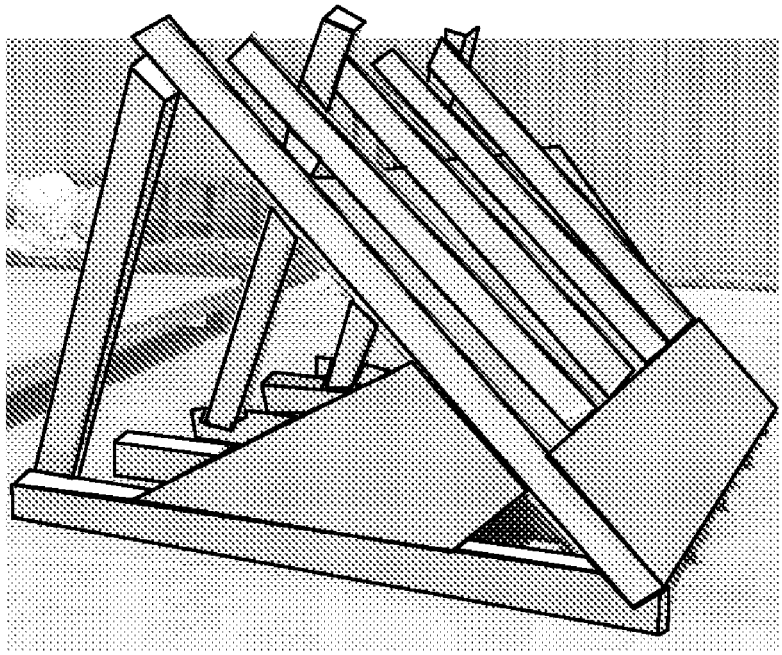
FIG. 11 is an illustration of a set up for a drop test as used in the Examples.
Figure 11:
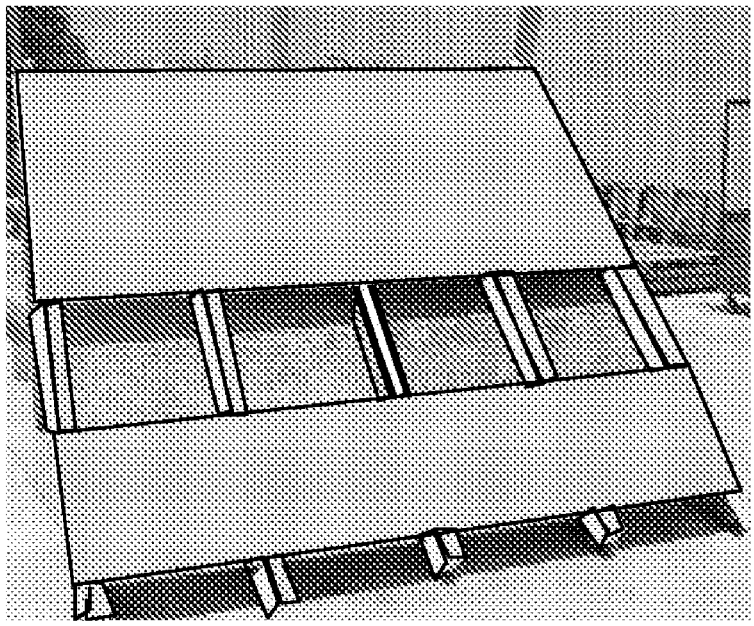
Figure 12:
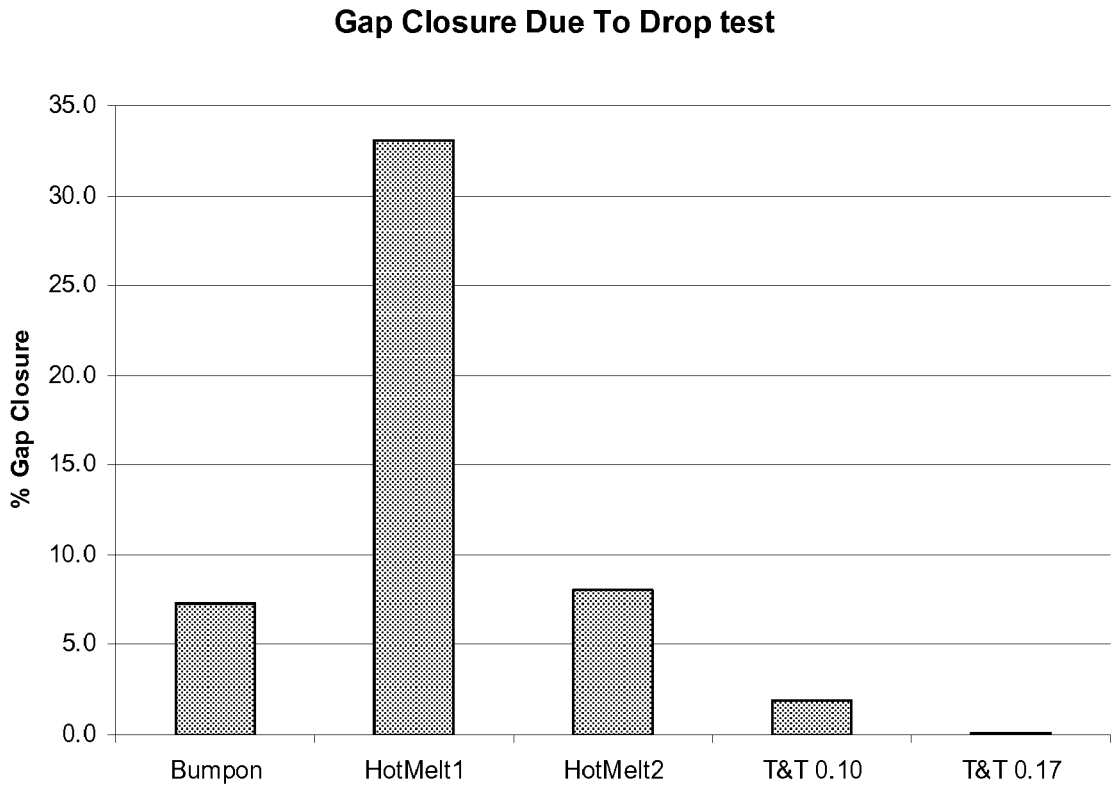
FIG. 12 is a graph illustrating a comparison of the % gap closure between drop test results for various example embodiments as shown and discussed in Example 5.
Figure 13:
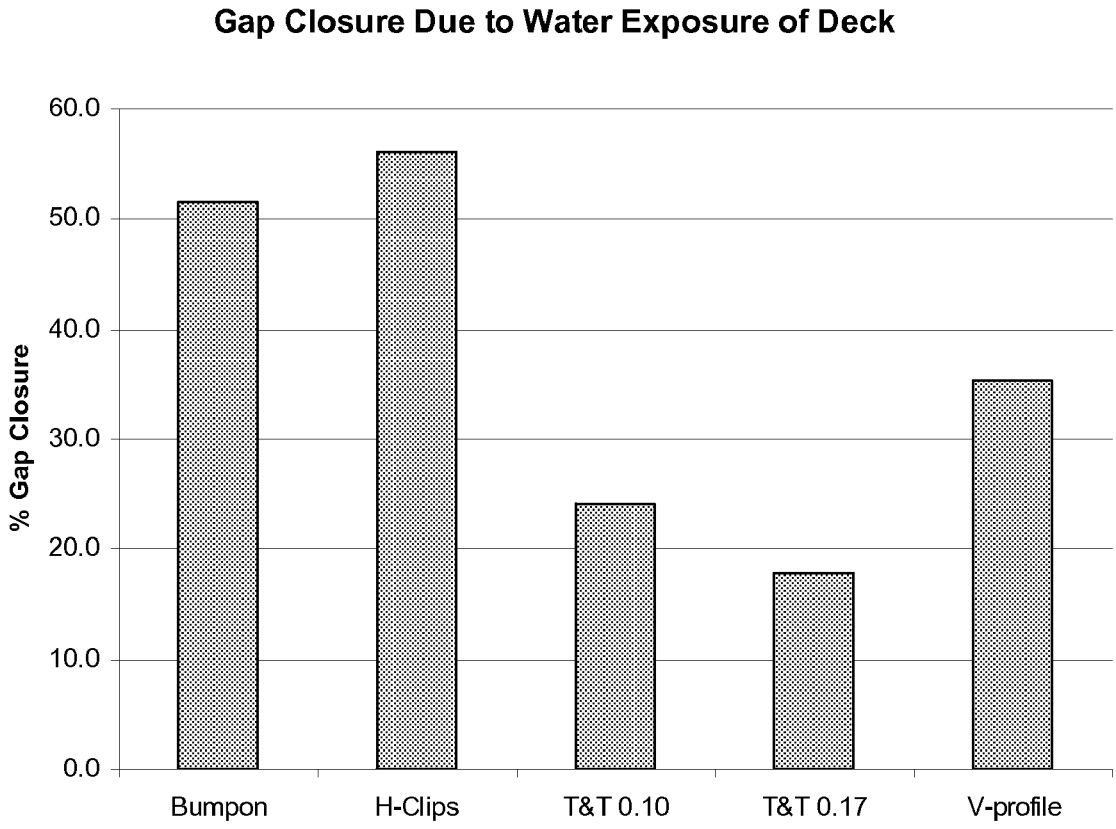
FIG. 13 is a graph illustrating a comparison of the % gap closure between weathering test results for various example embodiments and controls as shown and discussed in Example 2.
Figure 14:
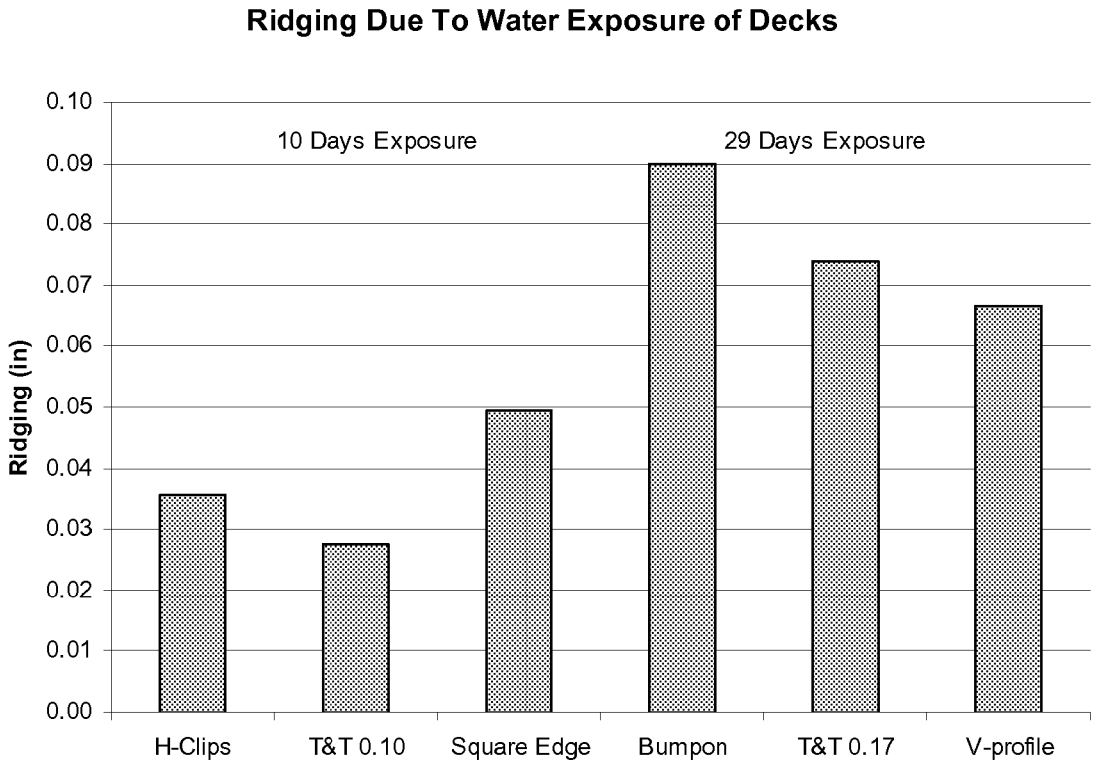
FIG. 14 is a graph illustrating a comparison of the ridging (in.) between weathering test results for various example embodiments and controls as shown and discussed in Example 2.
Figure 15:
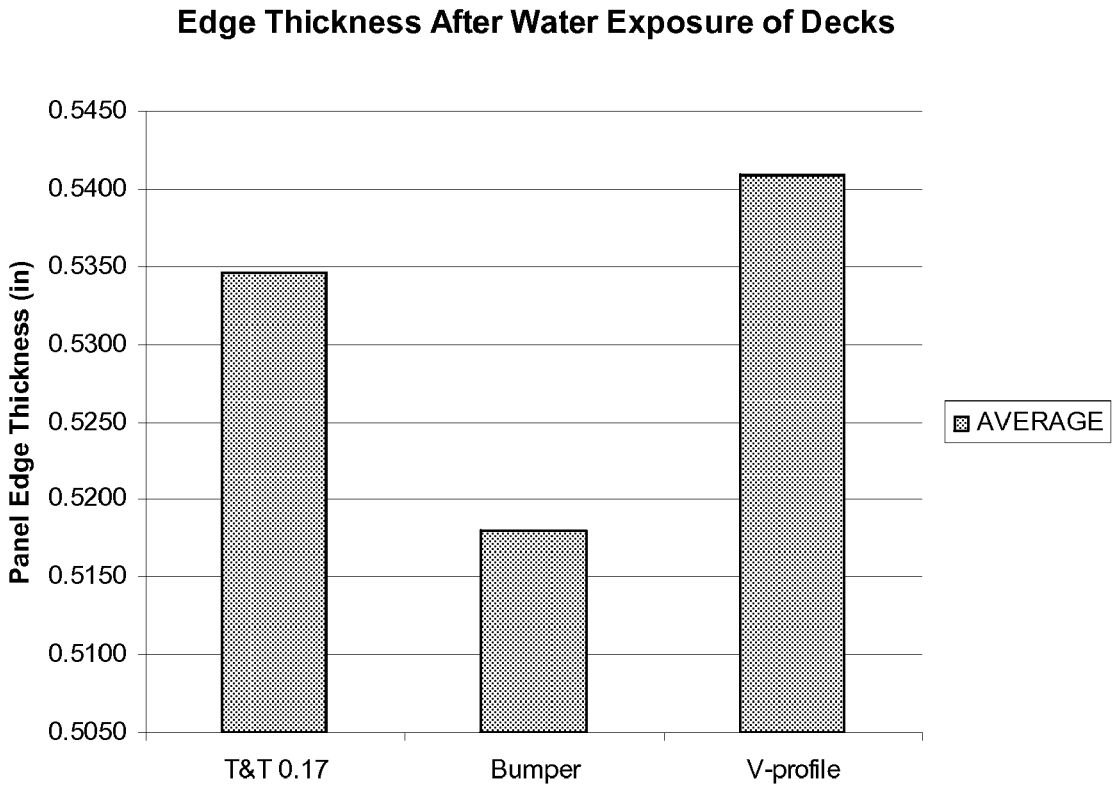
FIG. 15 is a graph illustrating a comparison of the panel edge thickness (in.) between weathering test results for various example embodiments as shown and discussed in Example 2.

A test frame simulating roof rafters or trusses 24" o.c. at a 12/12 pitch was used. The frame was 8' wide (4 spans). A 2'×8' strip of ½" ZIP™ sheathing with spacer prototypes was secured at the bottom of the frame with screws spaced 6" o.c. into the framing. See FIG. 11.

The full 4'×8' panel with prototype spacers was then placed on the frame and carefully lowered so that the spacers were in contact with the fixed panel strip spacers. The gap between the two panels was then measured at each spacer with calipers. This measurement was considered to be the initial gap.

The 4'×8' panel was then lifted up the framing 21" and allowed to slide down (free fall) so that the spacers impacted the spacers of the fixed panel. This drop was performed three times. Each time the gap at the spacers was measured. A change from the initial measurement is an indication of damage being done by the impact, either to the spacer or to the edge of one of the panels.

Results are shown in Table 2.

TABLE 2

Results of drop test for T&T embodiment.

| Replicate | | Left (in.) | Center (in.) | Right (in.) | Average (in.) |
|---|---|---|---|---|---|
| 1 | Initial Gap | 0.116 | 0.112 | 0.118 | 0.115 |
| | D1 | 0.117 | 0.107 | 0.120 | 0.115 |
| | D2 | 0.120 | 0.112 | 0.122 | 0.118 |
| | D3 | 0.125 | 0.107 | 0.130 | 0.120 |
| 2 | Initial Gap | 0.128 | 0.114 | 0.150 | 0.130 |
| | D1 | 0.144 | 0.112 | 0.139 | 0.131 |
| | D2 | 0.120 | 0.107 | 0.141 | 0.122 |
| | D3 | 0.123 | 0.111 | 0.138 | 0.124 |
| 3 | Initial Gap | 0.118 | 0.167 | 0.114 | 0.133 |
| | D1 | 0.116 | 0.126 | 0.115 | 0.119 |
| | D2 | 0.114 | 0.115 | 0.111 | 0.113 |
| | D3 | 0.117 | 0.117 | 0.108 | 0.114 |
| 4 | Initial Gap | 0.129 | 0.127 | 0.110 | 0.122 |
| | D1 | 0.171 | 0.125 | 0.145 | 0.147 |
| | D2 | 0.196 | 0.114 | 0.120 | 0.143 |
| | D3 | 0.140 | 0.106 | 0.133 | 0.126 |
| 5 | Initial Gap | 0.133 | 0.120 | 0.113 | 0.122 |
| | D1 | 0.145 | 0.116 | 0.110 | 0.123 |
| | D2 | 0.120 | 0.110 | 0.133 | 0.121 |
| | D3 | 0.114 | 0.105 | 0.150 | 0.123 |

D1 = gap after drop number 1;
D2 = gap after drop number 2; etc.

A T&T panel with a tongue thickness of 0.10" was tested by the drop test. Results are shown in Table 3.

TABLE 3

Results of drop test for T&T 0.10" embodiment.

| Replicate | | Left (in.) | Center (in.) | Right (in.) | Average (in.) |
|---|---|---|---|---|---|
| 1* | Initial Gap | 0.138 | 0.127 | 0.127 | 0.130 |
| | D1 | 0.137 | 0.127 | 0.131 | 0.131 |
| | D2 | 0.136 | 0.121 | 0.123 | 0.126 |
| | D3 | 0.131 | 0.126 | 0.128 | 0.128 |
| 2 | Initial Gap | 0.140 | 0.138 | 0.126 | 0.135 |
| | D1 | 0.136 | 0.137 | 0.131 | 0.135 |
| | D2 | 0.131 | 0.131 | 0.125 | 0.129 |
| | D3 | 0.138 | 0.135 | 0.130 | 0.134 |

*= position 1 slipped slightly on every drop, so panel put back in place prior to measurement A T&T panel with a tongue thickness of 0.17" was also tested by the drop test. Results are shown in Table 4.

TABLE 4

Results of drop test for T&T 0.17" embodiment.

| Replicate | | Left (in.) | Center (in.) | Right (in.) | Average (in.) |
|---|---|---|---|---|---|
| 1 | Initial Gap | 0.116 | 0.112 | 0.118 | 0.115 |
| | D1 | 0.117 | 0.107 | 0.120 | 0.115 |
| | D2 | 0.120 | 0.112 | 0.122 | 0.118 |
| | D3 | 0.125 | 0.107 | 0.130 | 0.120 |
| 2 | Initial Gap | 0.128 | 0.114 | 0.150 | 0.130 |
| | D1 | 0.144 | 0.112 | 0.139 | 0.131 |
| | D2 | 0.120 | 0.107 | 0.141 | 0.122 |
| | D3 | 0.123 | 0.111 | 0.138 | 0.124 |
| 3 | Initial Gap | 0.118 | 0.167 | 0.114 | 0.133 |
| | D1 | 0.116 | 0.126 | 0.115 | 0.119 |
| | D2 | 0.114 | 0.115 | 0.111 | 0.113 |
| | D3 | 0.117 | 0.117 | 0.108 | 0.114 |
| 4 | Initial Gap | 0.129 | 0.127 | 0.110 | 0.122 |
| | D1 | 0.171 | 0.125 | 0.145 | 0.147 |
| | D2 | 0.196 | 0.114 | 0.120 | 0.143 |
| | D3 | 0.140 | 0.106 | 0.133 | 0.126 |
| 5 | Initial Gap | 0.133 | 0.120 | 0.113 | 0.122 |
| | D1 | 0.145 | 0.116 | 0.110 | 0.123 |
| | D2 | 0.120 | 0.110 | 0.133 | 0.121 |
| | D3 | 0.114 | 0.105 | 0.150 | 0.123 |

The T&T 0.10" and T&T 0.17" did not show as much edge damage, as evidenced by gap closing after repeated drops, as other embodiments (results below in Examples). Other spacers tested compressed more, indicating they would not be as durable in withstanding jobsite damage.

Example 2

Weathering Test for Self-Spacing Panels

LE Weathering Test Procedure

Eight foot by 16' decks were constructed of 2'×10' lumber and various conventional panels or example panels according to the invention (T&T 0.10", T&T 0.17", V-groove, square edge (conventional), bump-on, and square edge with H-clips (conventional)) were installed on the decks. The panel edges on the outer ends of the deck were fixed by the test frame so they could not expand after installation. The panels were fastened to the deck normally using 8d nails. Initial measurements for LE, thickness, gap distance, and ridging were taken. LE was measured with LE grommets and a LE device according to PS2-04, §6.4.7. Thickness was measured with a micrometer. Gap distance was measured with a caliper. Ridging was measured by measuring the difference in height between reference points and a measurement point at the panel edges. A first reference point was 3" from the joint on one panel; a second reference point was 3" from the joint on the other panel. The measurement point was the highest point on either edge of the gap between the adjacent panels. Decks were continuously wetted with water sprinklers with complete coverage of spray over each deck at 133 gal/hr per deck for 13 days.

Measurements were taken again after wetting to compare how much the edges were compressed together and how this affected ridging. The 4'×8' panels were ½" thick panels with no edge seal, similar to commercially available ZIP System™ Roof Sheathing (Huber Engineered Woods LLC, Charlotte, N.C.).

Results are shown Tables 5-10.

TABLE 5

Gap Closure results.

| Spacer Type | 10 day gap closure % |
|---|---|
| T&T 0.10" | 17.2 |
| | 23.8 |
| | 24.0 |
| | 22.2 |
| | 16.0 |
| | 33.6 |
| | 30.2 |
| | 31.1 |
| | 33.0 |
| | 21.5 |
| | 22.2 |
| | 39.7 |
| | 20.3 |
| | 23.0 |
| | 5.0 |
| | 23.9 |
| H-Clips | 60.7 |
| | 65.1 |
| | 59.6 |
| | 52.5 |
| | 31.6 |
| | 57.6 |
| | 62.9 |
| | 77.2 |
| | 58.2 |
| | 58.5 |
| | 68.4 |
| | 87.7 |
| | 43.5 |
| | 32.3 |
| | 25.3 |
| | 58.0 |
| V profile | 21.5 |
| | 29.9 |
| | 31.4 |
| | 36.9 |
| | 39.0 |
| | 39.5 |
| | 50.0 |
| | 34.9 |
| T&T 0.17" | 9.7 |
| | 14.1 |
| | 15.1 |
| | 40.0 |
| | 18.3 |
| | 23.7 |
| | 9.9 |
| | 12.8 |
| Bumpons | 64.9 |
| | 49.7 |
| | 61.5 |
| | 60.5 |
| | 46.3 |
| | 53.1 |
| | 31.9 |
| | 44.4 |

TABLE 6

Summary of Gap Closure Weathering Data (least gap closure is best).

| Spacer Type | AVERAGE | Standard Deviation | N | |
|---|---|---|---|---|
| Bumpon | 51.5379 | 10.8550 | 8 | |
| H-Clips | 56.1957 | 16.4577 | 16 | ← Worst |
| T&T 0.10" | 24.1573 | 8.2084 | 16 | |
| T&T 0.17" | 17.9385 | 10.0228 | 8 | ← Best Performance = Least Gap closure |
| V-profile | 35.3944 | 8.3282 | 8 | |

TABLE 7

Linear Measurements of Ridging results.

| Spacer Type | Ridging (in.) |
|---|---|
| T&T 0.10" | 0.0149 |
| | 0.0281 |
| | 0.0763 |
| | 0.0095 |
| | 0.0273 |
| | 0.0121 |
| | 0.0675 |
| | 0.0231 |
| | 0.0440 |
| | −0.0013 |
| | 0.0734 |
| | 0.0080 |
| | −0.0097 |
| | −0.0127 |
| | 0.0544 |
| | 0.0252 |
| Square Edge | 0.0233 |
| | 0.1113 |
| | 0.0530 |
| | 0.0466 |
| | 0.0456 |
| | 0.0743 |
| | 0.0704 |
| | 0.0349 |
| | 0.0292 |
| | 0.0377 |
| | 0.1059 |
| | 0.0602 |
| | 0.0311 |
| | 0.0357 |
| | 0.0772 |
| | 0.0645 |
| H-Clips | 0.0267 |
| | 0.0203 |
| | 0.0429 |
| | 0.0535 |
| | 0.0221 |
| | 0.0129 |
| | 0.0557 |
| | 0.0664 |
| | 0.0227 |
| | 0.0082 |
| | 0.0625 |
| | 0.0443 |
| | 0.0161 |
| | 0.0091 |
| | 0.0399 |
| | 0.0649 |
| V-Profile | 0.0570 |
| | 0.0398 |
| | 0.0807 |
| | 0.0219 |
| | 0.0658 |
| | 0.1104 |
| | 0.0632 |
| | 0.0891 |
| | 0.0454 |
| | 0.0847 |
| | 0.0633 |
| | 0.1035 |
| | 0.0444 |
| | 0.0510 |
| | 0.0601 |
| | 0.1010 |
| T&T 0.17" | 0.0386 |
| | 0.0601 |
| | 0.0788 |
| | 0.0628 |
| | 0.0644 |
| | 0.0564 |
| | 0.0647 |
| | 0.0458 |
| | 0.0859 |
| | 0.0976 |
| | 0.1255 |
| | 0.0701 |

TABLE 7-continued

| Linear Measurements of Ridging results. | |
|---|---|
| Spacer Type | Ridging (in.) |
| Bumpons | 0.0755 |
| | 0.0852 |
| | 0.0661 |
| | 0.0522 |
| | 0.0903 |
| | 0.0981 |
| | 0.0970 |
| | 0.0816 |
| | 0.1073 |
| | 0.0998 |
| | 0.0878 |
| | 0.0860 |
| | 0.0877 |
| | 0.0897 |
| | 0.0916 |
| | 0.0816 |
| | 0.1000 |
| | 0.0692 |
| | 0.0995 |
| | 0.0869 |

TABLE 8

Summary of Ridging data (least ridging is best).

| Spacer Type | AVERAGE | Standard Deviation | N | Exposure Days | |
|---|---|---|---|---|---|
| H-Clips | 0.0355 | 0.0206 | 16 | 10 | |
| T&T 0.10" | 0.0277 | 0.0293 | 15 | 10 | ← Best Performance = Least ridging |
| Square Edge | 0.0494 | 0.0311 | 16 | 10 | ← Worst |
| Bumpon | 0.0899 | 0.0100 | 13 | 29 | ← Worst |
| T&T 0.17" | 0.0738 | 0.0199 | 16 | 29 | |
| V-profile | 0.0664 | 0.0261 | 16 | 29 | ← Best Performance = Least Ridging |

TABLE 9

Edge Thickness (inches) after 29 days exposure.

| T&T 0.17" | Bumpon | V-profile |
|---|---|---|
| 0.57805 | 0.55145 | 0.59615 |
| 0.5348 | 0.50405 | 0.55015 |
| 0.5239 | 0.4938 | 0.5425 |
| 0.5302 | 0.4925 | 0.5551 |
| 0.5482 | 0.48665 | 0.5553 |
| 0.52915 | 0.47695 | 0.54565 |
| 0.5156 | 0.49395 | 0.54705 |
| 0.5186 | 0.4838 | 0.5269 |
| 0.5249 | 0.4861 | 0.5354 |
| 0.5167 | 0.4795 | 0.52795 |
| 0.5594 | 0.48185 | 0.5371 |
| 0.52865 | 0.4864 | 0.5388 |
| 0.5298 | 0.48475 | 0.52465 |
| 0.52925 | 0.4829 | 0.5469 |
| 0.5283 | 0.4797 | 0.5453 |
| 0.5422 | 0.47945 | 0.54845 |
| 0.5801 | 0.6058 | 0.61695 |
| 0.536 | 0.5527 | 0.54715 |
| 0.5376 | 0.54575 | 0.5359 |
| 0.5277 | 0.53705 | 0.53095 |
| 0.5689 | 0.54805 | 0.53065 |
| 0.53215 | 0.5404 | 0.54685 |
| 0.52295 | 0.5383 | 0.5279 |
| 0.5199 | 0.5404 | 0.5287 |
| 0.51775 | 0.5341 | 0.52715 |
| 0.52385 | 0.52225 | 0.52325 |

TABLE 9-continued

Edge Thickness (inches) after 29 days exposure.

| | T&T 0.17" | Bumpon | V-profile |
|---|---|---|---|
| | 0.5297 | 0.55555 | 0.51845 |
| | 0.52435 | 0.5488 | 0.52305 |
| | 0.52655 | 0.5424 | 0.53015 |
| | 0.5232 | 0.54765 | 0.52245 |
| | 0.535 | 0.5388 | 0.52715 |
| | 0.5617 | 0.53215 | 0.5492 |
| Avg. | 0.534534 | 0.517936 | 0.540914 |
| Std. Dev. | 0.017216 | 0.0332 | 0.020353 |
| N | 32 | 32 | 32 |

TABLE 10

Summary of thickness results (least edge thickness is best).

| Spacer Type | AVERAGE | Standard Deviation | N | |
|---|---|---|---|---|
| T&T 0.17" | 0.5345 | 0.0172 | 32 | |
| Bumpon | 0.5179 | 0.0332 | 32 | ← Best |
| V-profile | 0.5409 | 0.0204 | 32 | ← Worst |

Example 3

Hot Melt (Adhesive) Spacer Drop Test

4'×8'×½" ZIP™ roofing panels (Huber Engineered Woods, LLC, Charlotte, N.C.) were prepared with three 2-inch beads of hot melt on an 8 foot edge evenly spaced. The first 2" long bead was applied 18" in from the corner, the second 47" from the corner, and the third 76" from the same corner. A first test panel used the Multi Lok® adhesive (HotMelt1); the second test panel used the high crystallized ethyl vinyl acetate adhesive (HotMelt2). The glue bead was manually applied with a "Minibead" hand held glue gun (Nordson, Westlake, Ohio). The bead thickness target was 0.125," but a range of 0.103" to 0.1480" was observed. The adhesive was allowed to cool at ambient temperature for 15 minutes prior to testing.

A drop test as described in Example 1 was performed with these panels. The 2'×8' strip of ½" ZIP™ sheathing had no spacers on it. The test panel was placed on the apparatus with the glue bead facing downward toward the fixed panel. The panels were gently placed against each other to measure the initial gap created by the adhesive bead. Three measurements were taken and recorded—one at each bead of glue. The gap was measured with a Mitutoyo Corp. digital caliper (Model No. CD-8"CS, Mitutoyo Corp., Aurora, Ill./Japan).

After measuring this baseline data, the test panel was slid upwards along the rafters and held in position (24" from the fixed panel) and then released by a tester. The panel slid down the pitched roof rafters and impacted the fixed panel below. The resulting gap of the panel was measured again and recorded. This process was repeated 3 times.

Initial drop test data indicated a reduction in bead thickness by 88%. To counteract this in a final design, the bead could possibly be oversized or more beads applied to account for the deformation loss and still achieve the desired ⅛" gap.

Results are shown in Table 11 for the HotMelt1 adhesive example embodiment.

TABLE 11

Results of drop test for HotMelt1 adhesive spacer embodiment.

| Replicate | | Left (in.) | Center (in.) | Right (in.) | Average (in.) |
|---|---|---|---|---|---|
| 1 | Initial Gap | 0.115 | 0.132 | 0.125 | 0.124 |
| | D1 | 0.094 | 0.083 | 0.095 | 0.090 |
| | D2 | 0.079 | 0.071 | 0.100 | 0.083 |
| | D3 | 0.047 | 0.058 | 0.087 | 0.064 |
| 2 | Initial Gap | 0.123 | 0.148 | 0.121 | 0.131 |
| | D1 | 0.073 | 0.093 | 0.075 | 0.080 |
| | D2 | 0.060 | 0.086 | 0.069 | 0.072 |
| | D3 | 0.058 | 0.078 | 0.081 | 0.072 |
| 3 | Initial Gap | 0.121 | 0.135 | 0.114 | 0.123 |
| | D1 | 0.078 | 0.085 | 0.076 | 0.080 |
| | D2 | 0.085 | 0.085 | 0.067 | 0.079 |
| | D3 | 0.085 | 0.079 | 0.071 | 0.078 |
| 4 | Initial Gap | 0.129 | 0.126 | 0.125 | 0.127 |
| | D1 | 0.110 | 0.083 | 0.084 | 0.092 |
| | D2 | 0.126 | 0.068 | 0.036 | 0.077 |
| | D3 | 0.125 | 0.058 | 0.040 | 0.074 |
| 5 | Initial Gap | 0.103 | 0.123 | 0.112 | 0.113 |
| | D1 | 0.056 | 0.073 | 0.087 | 0.072 |
| | D2 | 0.054 | 0.058 | 0.070 | 0.060 |
| | D3 | 0.048 | 0.057 | 0.073 | 0.059 |

Results for the HotMelt2 adhesive example embodiment are shown in Table 12.

TABLE 12

Results of drop test for HotMelt2 adhesive spacer embodiment.

| Replicate | | Left (in.) | Center (in.) | Right (in.) | Average (in.) |
|---|---|---|---|---|---|
| 1 | Initial Gap | 0.075 | 0.080 | 0.090 | 0.082 |
| | D1 | 0.070 | 0.072 | 0.072 | 0.071 |
| | D2 | 0.071 | 0.058 | 0.123 | 0.084 |
| | D3 | 0.064 | 0.054 | 0.136 | 0.085 |
| 2 | Initial Gap | 0.102 | 0.073 | 0.107 | 0.094 |
| | D1 | 0.100 | 0.071 | 0.111 | 0.094 |
| | D2 | 0.119 | 0.064 | 0.096 | 0.093 |
| | D3 | 0.093 | 0.077 | 0.104 | 0.091 |
| 3 | Initial Gap | 0.116 | 0.076 | 0.100 | 0.097 |
| | D1 | 0.092 | 0.057 | 0.083 | 0.077 |
| | D2 | 0.084 | 0.060 | 0.084 | 0.076 |
| | D3 | 0.068 | 0.054 | 0.074 | 0.065 |

Example 4

"Bump On" Spacer Drop Test

Two 3M™ Bumpon™ (model SJ-5008, tapered square 0.5" wide×0.12" high, 8×10 matrix form, 3M, St. Paul, Minn.) pressure sensitive adhesive-backed polyurethane spacers were adhesively attached to panels of 4'×8'×½" ZIP™ sheathing (Huber Engineered Woods, LLC, Charlotte, N.C.) on the 8' edge of a panel 18" from each end (two spacer on the edge).

A drop test as described in Example 1 was performed with this panel. The 2'×8' strip of ½" ZIP™ sheathing had no spacers on it.

Results are shown in Table 13.

TABLE 13

Results of drop test for "bump-on" spacer embodiment.

| Replicate | | Left (in.) | Center (in.) | Right (in.) | Average (in.) |
|---|---|---|---|---|---|
| 1 | Initial Gap | 0.126 | 0.107 | 0.135 | 0.122 |
| | D1 | 0.127 | 0.104 | 0.141 | 0.124 |
| | D2 | 0.123 | 0.095 | 0.127 | 0.115 |
| | D3 | 0.127 | 0.099 | 0.159 | 0.128 |
| 2 | Initial Gap | 0.125 | 0.126 | 0.126 | 0.126 |
| | D1 | 0.124 | 0.121 | 0.138 | 0.128 |
| | D2 | 0.125 | 0.117 | 0.144 | 0.128 |
| | D3 | 0.139 | 0.120 | 0.119 | 0.126 |
| 3 | Initial Gap | 0.118 | 0.159 | 0.118 | 0.131 |
| | D1 | 0.115 | 0.119 | 0.129 | 0.121 |
| | D2 | 0.121 | 0.106 | 0.130 | 0.119 |
| | D3 | 0.143 | 0.118 | 0.133 | 0.131 |
| 4 | Initial Gap | 0.117 | 0.143 | 0.125 | 0.128 |
| | D1 | 0.109 | 0.107 | 0.117 | 0.111 |
| | D2 | 0.123 | 0.108 | 0.138 | 0.123 |
| | D3 | 0.123 | 0.099 | 0.112 | 0.111 |
| 5 | Initial Gap | 0.131 | 0.125 | 0.124 | 0.127 |
| | D1 | 0.108 | 0.121 | 0.112 | 0.113 |
| | D2 | 0.132 | 0.116 | 0.129 | 0.125 |
| | D3 | 0.128 | 0.096 | 0.139 | 0.121 |

Example 5

Summary of Drop Tests

Below is a summary of the drop tests performed for easier comparison between embodiments.

TABLE 14

Raw Data Summary of Drop Tests.

| Spacer Type | Drop | Gap Closure (%) |
|---|---|---|
| T&T 0.10" | 1 | −0.767263427 |
| | 2 | 3.069053708 |
| | 3 | 1.662404092 |
| | 1 | 0.123762376 |
| | 2 | 4.331683168 |
| | 3 | 0.371287129 |
| HotMelt2 | 1 | 12.85714286 |
| | 2 | −2.816326531 |
| | 3 | −3.591836735 |
| | 1 | −0.177935943 |
| | 2 | 1.245551601 |
| | 3 | 2.846975089 |
| | 1 | 20.79037801 |
| | 2 | 21.99312715 |
| | 3 | 32.81786942 |
| Bumpon | 1 | −1.089918256 |
| | 2 | 6.267029973 |
| | 3 | −4.768392371 |
| | 1 | −1.593625498 |
| | 2 | −2.257636122 |
| | 3 | −0.26560425 |
| | 1 | 7.750952986 |
| | 2 | 9.656925032 |
| | 3 | 0.254129606 |
| | 1 | 13.41145833 |
| | 2 | 4.166666667 |
| | 3 | 13.28125 |
| | 1 | 10.65789474 |
| | 2 | 1.052631579 |
| | 3 | 4.736842105 |
| HotMelt1 | 1 | 27.05248991 |
| | 2 | 32.97442799 |
| | 3 | 48.45222073 |

TABLE 14-continued

Raw Data Summary of Drop Tests.

| Spacer Type | Drop | Gap Closure (%) |
|---|---|---|
| | 1 | 38.56742289 |
| | 2 | 45.3224573 |
| | 3 | 44.81264339 |
| | 1 | 35.45331529 |
| | 2 | 36.12990528 |
| | 3 | 36.53585927 |
| | 1 | 27.23684211 |
| | 2 | 39.60526316 |
| | 3 | 41.44736842 |
| | 1 | 36.2962963 |
| | 2 | 46.37037037 |
| | 3 | 47.40740741 |
| T&T 0.17" | 1 | 0.607638889 |
| | 2 | −2.28587963 |
| | 3 | −4.456018519 |
| | 1 | −0.639386189 |
| | 2 | 6.265984655 |
| | 3 | 5.115089514 |
| | 1 | 10.42713568 |
| | 2 | 14.57286432 |
| | 3 | 14.32160804 |
| | 1 | −20.24623803 |
| | 2 | −17.23666211 |
| | 3 | −3.283173735 |
| | 1 | −1.371742112 |
| | 2 | 0.411522634 |
| | 3 | −1.09739369 |

TABLE 15

Summary of Drop Test Data (least gap closure is best performance).

| Spacer Type | AVERAGE | Standard Deviation | N | |
|---|---|---|---|---|
| Bumpon | 7.3521 | 10.2170 | 6 | |
| HotMelt1 | 33.0451 | 13.6364 | 9 | ← Worst |
| HotMelt2 | 8.0020 | 13.4554 | 15 | |
| T&T 0.10" | 1.8793 | 6.0641 | 15 | |
| T&T 0.17" | 0.0737 | 9.7777 | 15 | ← Best Performance = Least Gap closure |

As can be seen from the above data, the T&T profile performed best overall in testing.

Throughout this application, various publications are referenced. The disclosures of these publications in their entireties are hereby incorporated by reference into this application in order to more fully describe the compounds, compositions and methods described herein.

Various modifications and variations can be made to the compounds, compositions and methods described herein. Other aspects of the compounds, compositions and methods described herein will be apparent from consideration of the specification and practice of the compounds, compositions and methods disclosed herein. It is intended that the specification and examples be considered as exemplary.

What is claimed is:

1. A system, comprising:

a plurality of self-spacing composite wood panels, each panel having a first longitudinal side and a second longitudinal side and each panel comprising:

an upper surface layer and a lower surface layer, wherein the upper and lower surface layers are substantially parallel, wherein the upper and lower surface layers each have first and second longitudinal edges, and a core layer positioned between the upper and lower surface layers, wherein at least a portion of the core layer extends beyond the first and second longitudinal edges of the upper and lower surface layers, thereby forming a first tongue along the first longitudinal side of the panel, and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein the plurality of self-spacing panels are configured to be installed on a support structure adjacent one another such that the first tongue head wall of each panel faces and abuts the second tongue head wall of an adjacent panel and the first longitudinal edges of the upper and lower surface layers of each panel do not abut the second longitudinal edges of the upper and lower surface layers of the adjacent panel but instead form upper and lower gaps therebetween.

2. The system of claim 1 wherein the first tongue extends along the first longitudinal side.

3. The system of claim 1 wherein the first tongue extends along discrete portions of the longitudinal side.

4. The system of claim 1 wherein the composite panel is an oriented strand board panel.

5. The system of claim 1 wherein the upper and lower surface layers each further have first and second transverse edges and wherein at least a portion of the core layer extends beyond the first transverse edges of the upper and lower surface layers thereby forming a third tongue.

6. The system of claim 5 wherein at least a portion of the core layer extends beyond the second transverse edges of the upper and lower surface layers thereby forming a fourth tongue.

7. The system of claim 1 wherein the first tongue extends a pre-determined distance beyond the first longitudinal edges of the upper and lower surface layers that is sufficient to prevent visible damage or modification to a surface of a panel upon linear expansion of the panel when positioned adjacent a second panel.

8. The system of claim 7, wherein the pre-determined distance is at least about 1/16".

9. The system of claim 1 wherein the first tongue comprises a head, an upper wall, and a lower wall extending from the first longitudinal side of the panel.

10. The system of claim 1 further comprising an overlay on at least one surface of the panel.

11. The system of claim 1 wherein the entire core layer extends beyond the first and second longitudinal edges of the first and second surface layers.

12. The system of claim 1 wherein the thickness of the first tongue is about 0.10" to about 0.17" and wherein the panel thickness is about 0.5".

13. A system, comprising:

a plurality of self-spacing paper overlaid oriented strand board panels, each panel having a first longitudinal side and a second longitudinal side, and each panel comprising:

a first surface layer and a second surface layer, wherein the first and second surface layers are substantially parallel, wherein the first and second surface layers each have first and second longitudinal edges, and wherein the first and second longitudinal edges are substantially parallel, a core layer positioned between the first and second surface layers, wherein at least a portion of the core layer extends beyond the first and second longitudinal edges of the first and second surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, and a resin impregnated paper overlay adhesively secured at least one surface of the oriented strand board panel, the paper overlay having a basis weight of about 25 lbs./msf to about 75 lbs./msf and a resin content of about 20% to about 60% by dry weight, wherein when the plurality of self-spacing paper overlaid oriented strand board panels are arranged adjacent one another, at the first tongue head wall of each panel faces and abuts the second tongue head wall of an adjacent panel, and the first longitudinal edges of the upper and lower surface layers of each panel do not abut the second longitudinal edges of the upper and lower surface layers of the adjacent panel but instead form upper and lower gaps therebetween.

14. A system, comprising:

a plurality of self-spacing composite wood panels, each panel having a first longitudinal side and a second longitudinal side and each panel comprising:

a first surface layer and a second surface layer, wherein the first and second surface layers are substantially parallel, wherein the first and second surface layers each have first and second longitudinal edges, and wherein the first and second longitudinal edges are substantially parallel, and a core layer positioned between the first and second surface layers, wherein at least a portion of the core layer extends beyond the first and second longitudinal edges of the first and second surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein upon placing a first panel of the plurality of self-spacing panels adjacent a second panel of the plurality of self-spacing panels, the first tongue head wall of the first panel faces and abuts the second tongue head wall of the second panel thereby forming an upper channel and a lower channel between the adjacent panels, wherein the upper channel is defined between adjacent first and second surface layers of the first and second panels, and wherein the lower channel is defined between adjacent first and second surface layers of the first and second panels, and wherein upon placing a third panel of the plurality of self-spacing panels adjacent the second panel, the first tongue head wall of the third panel faces and abuts the second tongue head wall of the second panel.

15. The system of claim 14, wherein the tongue of the first panel pushes into the first panel upon linear expansion of the first or second panel.

16. A system, comprising:

a plurality of self-spacing oriented strand board panels, each having a first longitudinal side and a second longitudinal side and each panel comprising:

an upper surface layer and a lower surface layer, wherein the upper and lower surface layers are substantially parallel, wherein the upper and lower surface layers each have first and second longitudinal edges, and wherein the first and second longitudinal edges are substantially parallel, and a core layer positioned between the upper and lower surface layers, wherein at least a portion of the core layer extends beyond the first and second longitudinal edges of the upper and lower surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein upon placing a first panel of the plurality of self-spacing oriented strand board panels adjacent a second panel of the plurality of self-spacing oriented strand board panels, the first tongue head wall of the first panel faces and abuts the first second tongue head wall of the second panel thereby forming an upper channel and a lower channel between the adjacent panels, wherein the upper channel is defined between adjacent upper surface layers of the first and second panels, and wherein the lower channel is defined between adjacent lower surface layers of the first and second panels, and wherein upon placing a third panel of the plurality of self-spacing oriented strand board panels adjacent the second self-spacing oriented strand board panel, the first tongue head wall of the third panel faces and abuts the second tongue head wall of the second panel.

17. The system of claim 16 wherein each self-spacing composite wood panel further comprises an overlay on at least one surface of the panel.

18. The system of claim 16 further comprising tape for sealing at least one joint between adjacent self-spacing composite wood panels.

19. The system of claim 16, wherein the tongue of the first panel pushes into the first panel upon linear expansion of the first or second panel.

20. A method of forming an assembly of self-spacing wood composite panels, comprising:

placing a plurality of self-spacing composite wood panels adjacent each other, wherein each panel has a first longitudinal side and a second longitudinal side and each panel comprises:

a first surface layer and a second surface layer, wherein the first and second surface layers each have first and second longitudinal edges, and wherein the first and second longitudinal edges are substantially parallel, and a core layer positioned between the first and second surface layers, wherein at least a portion of the core layer extends beyond the first and second longitudinal edges of the first and second surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein upon placing a first panel of the plurality of self-spacing panels-adjacent a second panel of the plurality of self-spacing panels, the first tongue a head wall of the first panel faces and abuts the second tongue a head wall of the second panel thereby forming an upper channel and a lower channel between the adjacent panels, wherein the upper channel is defined between adjacent first and second surface layers of the first and second panels, and wherein the lower channel is defined between adjacent first and second surface layers of the first and second panels.

21. The method of claim 20 wherein the step of placing the first panel adjacent the second panel further includes placing the first and second panels on a support structure.

22. The method of claim 21 further comprising securing the panels to the support structure.

23. The method of claim 22 further comprising taping at least one joint between adjacent panels with a weather-resistant tape.

24. The method of claim 20, wherein the tongue of the first panel pushes into the first panel upon linear expansion of the first or second panel.

25. A roof, wall, or floor, comprising:

a support structure; and a plurality of self-spacing composite wood panels, wherein the plurality of self-spacing composite wood panels are attached to the support structure and wherein each panel has a first longitudinal side and a second longitudinal side and comprises:

an upper surface layer and a lower surface layer, wherein the upper and lower surface layers are substantially parallel, wherein the upper and lower surface layers each have first and second longitudinal edges, and wherein the first and second longitudinal edges are substantially parallel, and a core layer positioned between the upper and lower surface layers, wherein at least a portion of the core layer extends beyond the first and second longitudinal edges of the upper and lower surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein the first tongue head wall of each of the plurality of self-spacing composite wood panels faces and abuts the second tongue head wall of an adjacent self-spacing composite wood panel and the first longitudinal edges of the upper and lower surface layers of each panel do not abut the second longitudinal edges of the upper and lower surface layers of the adjacent panel but instead form upper and lower gaps therebetween.

26. The roof, wall, or floor of claim 25, wherein the tongue of the first panel pushes into the first panel upon linear expansion of the first or second panel.

27. A method of constructing a roof, wall, or floor, comprising:

placing a first self-spacing composite wood panel adjacent a second self-spacing composite wood panel and a third self-spacing composite wood panel adjacent the second self-spacing composite wood panel, wherein each panel has a first longitudinal side and a second longitudinal side and each panel further comprises:

a first surface layer and a second surface layer, wherein the first and second surface layers are substantially parallel, wherein the first and second surface layers each have first and second longitudinal edges, and wherein the first and second longitudinal edges are substantially parallel, and a core layer positioned between the first and second surface layers, wherein at least a portion of the core layer extends beyond the first and second longitudinal edges of the first and second surface layers, thereby forming a first tongue along the first longitudinal side of the panel and a second tongue along the second longitudinal side of the panel, with the first and second tongues each defining an upper wall extending outward beyond the corresponding longitudinal edges of the upper surface layer, a lower wall extending outward beyond the corresponding longitudinal edges of the lower surface layer, and a head wall extending therebetween, with the first tongue head wall and the second tongue head wall in longitudinal alignment, wherein upon placing the first self-spacing panel adjacent the second self-spacing panel, the first tongue head wall of the first panel faces and abuts the second tongue head wall of the second panel thereby forming an upper channel and a lower channel between the adjacent panels, wherein the upper channel is defined between adjacent first and second surface layers of the first and second panels, and wherein the lower channel is defined between adjacent first and second surface layers of the first and second panels, and wherein upon placing the third self-spacing panel adjacent the second self-spacing panel, the first tongue head wall of the third panel faces and abuts the second tongue head wall of the second panel; and securing the panels to a support structure.

* * * * *